US010186845B2

(12) United States Patent
Sumoyama et al.

(10) Patent No.: US 10,186,845 B2
(45) Date of Patent: Jan. 22, 2019

(54) ELECTRODE TIP FOR SPARK PLUG, AND SPARK PLUG

(71) Applicant: NGK SPARK PLUG CO., LTD., Nagoya-shi, Aichi (JP)

(72) Inventors: Daisuke Sumoyama, Nagoya (JP); Tatsuya Gozawa, Komaki (JP); Magoki Shimadate, Takahama (JP); Yusuke Kawashima, Kakamigahara (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 11 days.

(21) Appl. No.: 15/315,105

(22) PCT Filed: May 26, 2015

(86) PCT No.: PCT/JP2015/002663
§ 371 (c)(1),
(2) Date: Nov. 30, 2016

(87) PCT Pub. No.: WO2015/186315
PCT Pub. Date: Dec. 10, 2015

(65) Prior Publication Data

US 2017/0187170 A1 Jun. 29, 2017

(30) Foreign Application Priority Data

Jun. 3, 2014 (JP) ..... 2014-114701

(51) Int. Cl.
*H01T 13/39* (2006.01)
*H01T 13/32* (2006.01)

(52) U.S. Cl.
CPC ..... *H01T 13/39* (2013.01); *H01T 13/32* (2013.01)

(58) Field of Classification Search
None
See application file for complete search history.

(56) References Cited

U.S. PATENT DOCUMENTS

| | | | | |
|---|---|---|---|---|
| 4,700,103 | A | 10/1987 | Yamaguchi et al. | 313/141 |
| 2002/0121849 | A1 | 9/2002 | Kanao et al. | 313/141 |
| 2008/0074025 | A1 | 3/2008 | Hori | 313/141 |
| 2013/0069516 | A1 | 3/2013 | Sumoyama et al. | 313/141 |

FOREIGN PATENT DOCUMENTS

| | | | | |
|---|---|---|---|---|
| JP | S61-171080 | A | 8/1986 | H01T 13/34 |
| JP | 2001-244042 | A | 9/2001 | H01T 13/20 |
| JP | 2005-108794 | A | 4/2005 | H01T 13/20 |

(Continued)

OTHER PUBLICATIONS

International Search Report issued in corresponding International Patent Application No. PCT/JP2015/002663, dated Jul. 21, 2015.

*Primary Examiner* — Nimeshkumar Patel
*Assistant Examiner* — Jacob R Stern
(74) *Attorney, Agent, or Firm* — Kusner & Jaffe

(57) ABSTRACT

An electrode tip for a spark plug, wherein Pt is contained as a main component, 7% by mass or more of Rh is contained, and a total content of Pt and Rh is greater than or equal to 95% by mass. The electrode tip includes: a narrow portion having the same cross-sectional shape in a direction of an axis; and a wide portion which is adjacent to the narrow portion and has a cross-sectional area, in a radial direction, which is greater than the narrow portion.

6 Claims, 6 Drawing Sheets

(56) References Cited

FOREIGN PATENT DOCUMENTS

| | | | | |
|---|---|---|---|---|
| JP | 2005-158322 | A | 6/2005 | H01T 13/20 |
| JP | 2005-158323 | A | 6/2005 | B23K 11/00 |
| JP | 3702838 | B2 | 7/2005 | H01T 13/32 |
| JP | 4015808 | B2 | 9/2007 | H01T 13/20 |
| JP | 2008-034393 | A | 2/2008 | B23K 26/20 |
| JP | 2008-077838 | A | 4/2008 | C22C 5/04 |
| JP | 2011-258510 | A | 12/2011 | C22C 5/04 |

ELECTRODE TIP FOR SPARK PLUG, AND SPARK PLUG

RELATED APPLICATIONS

This application is a National Stage of International Application No. PCT/JP15/02663 filed May 26, 2015, which claims the benefit of Japanese Patent Application No. 2014-114701, filed Jun. 3, 2014.

FIELD OF THE INVENTION

The present invention relates to an electrode tip for a spark plug, and a spark plug having the electrode tip.

BACKGROUND OF THE INVENTION

A spark plug is used for ignition of an internal combustion engine such as an automobile engine. The spark plug generally includes a tubular metallic shell, a tubular insulator disposed in an inner hole of the metallic shell, a center electrode disposed in a front side inner hole of the insulator, and a ground electrode joined at one end thereof to the front side of the metallic shell with a spark discharge gap provided between the other end of the ground electrode and the center electrode. The spark plug causes spark discharge at the spark discharge gap formed between the front end of the center electrode and the front end of the ground electrode in a combustion chamber of an internal combustion engine, to burn fuel with which the combustion chamber is filled.

In recent years, the temperature in the combustion chamber tends to be enhanced for high output and improvement of fuel efficiency. Further, an engine in which a discharge portion forming the spark discharge gap is disposed so as to project into the combustion chamber in order to improve ignitability, has been brought into use. In such circumstances, since the discharge portion of the spark plug is subject to high temperature, oxidation wear tends to progress in the center electrode and the ground electrode that form the discharge portion. Therefore, a method in which tips are formed at the opposing front ends of the center electrode and the ground electrode, to cause spark discharge between the tips, thereby reducing the oxidation wear of the center electrode and the ground electrode (hereinafter, may be each referred to as an electrode), is being developed.

Further, attempt is made for achieving both high output and improvement of fuel efficiency by enhancement of a combustion pressure which is brought by engine downsizing and use of a direct injection turbo engine. In such an engine, a difference in temperature in the combustion chamber between in combustion and in intake charge, is increased, and a difference in temperature in the combustion chamber between in supercharging and in normal operation, is also increased. Thus, the spark plug tends to be placed in a severe thermal cycle environment. Therefore, a problem arises that the tip is likely to peel off. Further, a pressure in the combustion chamber is likely to be increased, and, according to the increase of the pressure in the combustion chamber, a spark discharge voltage is increased, so that a problem arises that the spark wear is likely to be caused at the tip. Therefore, not only the problem that oxidation wear due to high temperature is to be reduced but also the problem that peeling of the tip from the electrode due to the severe thermal cycle is to be reduced, and spark wear at the tip due to increase of a spark discharge voltage is to be reduced, need to be simultaneously overcome.

As a method for solving the problem, among the problems, that peeling of the tip from the electrode is to be reduced, a method is suggested in which a tip, having a flange portion, such as an electrode tip "having, at the one end of the electrode tip, a flange portion having a diameter larger than the diameter of the other end" (Japanese Patent No. 4015808) and a tip "formed by a flange portion and a projection that projects from one surface of the flange portion" (Japanese Patent Application Laid-Open (kokai) No. 2008-34393), is used.

JP 4015808 and JP 2008-34393 disclose that, for example, "an alloy that contains Ir as a main component and contains: "(1) 3 to 50% by mass of Rh, (2) 1 to 10% by mass of Pt, or (3) 50% by mass or less of Rh and one of Ru or Pt in total, and 1% by mass or more of Rh, 1% by mass or more of Ru, and 1% by mass or more of Pt", is used as a material of the tip (see claim 5 of JP 4015808), and "a Pt alloy that contains at least one of 20 to 60% by mass of Rh, 10 to 40% by mass of Ir, and 1 to 20% by mass of Ni", is used as a material of the tip (see paragraph 0022 of JP 2008-34393). Meanwhile, as described above, since a spark plug that can exhibit a desired performance under a severe environment, is required, use of a material of the tip which is still further excellent in oxidation resistance and spark wear resistance is desired. When a Pt—Rh based alloy is used as a material of a tip having a flange portion, both oxidation resistance and spark wear resistance as well as peeling resistance may be improved. In particular, a tip formed from an alloy, among Pt—Rh-based alloys, in which the content of elements other than Pt and Rh is less than 5% by mass is particularly excellent in oxidation resistance. However, the alloy in which the content of elements other than Pt and Rh is less than 5% by mass is softer than an Ir alloy, a Pt—Ir-based alloy, a Pt—Rh-based alloy that contains 5% by mass or more of elements other than Pt and Rh, and the like, and it is found that a problem arises that, when a tip having a flange portion is welded to an electrode by resistance welding, the tip is likely to be deformed, and the dimension such as the height of the welded tip is not stabilized. That is, the tip, having a flange portion, formed from a Pt—Rh-based alloy in which the content of elements other than Pt and Rh is less than 5% by mass, is excellent in oxidation resistance and spark wear resistance, while the tips are likely to vary in quality as a product, thereby reducing a yield. Further, also when the tip is held and welded by laser welding without performing resistance welding, there is much concern that the dimension of the welded tip is less likely to be stabilized for the same reason.

Further, Japanese Patent Application Laid-Open (kokai) No. 2005-158322 discloses that resistance welding between a precious metal tip, and a ground electrode or a center electrode is performed to form a flange portion at the bottom portion of the precious metal tip by expansion of the outer diameter of the precious metal tip, whereby peeling of the precious metal tip from the ground electrode or the center electrode is inhibited (see claims 1 and 2, and paragraph 0006 of JP 2005-158322). In example 1 of JP 2005-158322, a precious metal tip formed from a platinum-rhodium alloy is used. However, a platinum-rhodium alloy is soft, and is likely to be deformed. Therefore, a problem may arise that the dimension of the precious metal tip having been welded by resistance welding is not stabilized.

Further, in order to improve wear resistance, the diameter of the tip tends to be increased. An amount of heat required for resistance welding for assuring joining strength is increased according to increase of the diameter of the tip. Therefore, in a case where a tip for which the Pt—Rh-based alloy is used for improving oxidation resistance and spark wear resistance, and which has the flange portion disclosed in JP 4015808 or JP 2008-34393, or has the flange portion formed by resistance welding as disclosed in JP 2005-158322 for assuring peeling resistance, is used, since an amount of heat at resistance welding is increased according to increase of the diameter of the tip, so that a problem arises that the dimension of the tip having been welded by resistance welding is less likely to be stabilized. Further, for example, a problem may arise that spatters and welding droop are generated at the resistance welding, whereby the quality is not stabilized, and a yield is significantly reduced.

Further, for the tip having the flange portion disclosed in JP 4015808 and JP 2008-34393, when the thickness of the flange portion is small, resistance welding needs to be performed while the flange portion is held in order to reduce deformation of the flange portion. At this time, the welding electrode contacts with a portion near a welding surface which is heated, whereby the welding electrode is overheated and the life span of a tool such as the welding electrode is significantly reduced. As a result, for the tip having the flange portion, not only the processing cost is high, but also cost is increased also in production process. Also for the tip having the flange portion formed by resistance welding as disclosed in JP 2005-158322, a great amount of heat is required in order to deform the tip. Therefore, the life span of the tool such as the welding electrode is significantly reduced, resulting in increase of cost.

The present invention is made in view of the above-mentioned problem. Specifically, an object of the present invention is to provide, at low cost, an electrode tip that has oxidation resistance, spark wear resistance, and peeling resistance, and that is less likely to be deformed when welded to an electrode, and a spark plug having the electrode tip.

SUMMARY OF THE INVENTION

In accordance with a first aspect of the present invention, there is provided an electrode tip for a spark plug, wherein, in the electrode tip, (1) Pt is contained as a main component, 7% by mass or more of Rh is contained, and a total content of Pt and Rh is greater than or equal to 95% by mass, a narrow portion having a column-like shape and having the same cross-sectional shape in a direction of an axis; and a wide portion adjacent to the narrow portion, the wide portion having a cross-sectional area, in a direction orthogonal to the axis, which is greater than the narrow portion, are provided, on any cross-section cut at a plane including the axis, at least a part of a contour, representing an outer surface of the wide portion, from a boundary point between the narrow portion and the wide portion on an outer surface of the narrow portion and the wide portion, to an end point, on the boundary point side, among two points representing edge sides of an end surface of the wide portion, is positioned on a straight line connecting between the boundary point and the end point and/or outward of the straight line in a radial direction relative to the axis, when H represents a tip height representing a distance from an end surface of the narrow portion to the end surface of the wide portion, and h represents a wide portion height representing a distance from the boundary point to the end surface of the wide portion, a ratio (h/H×100) of the wide portion height h to the tip height H is greater than or equal to 35%, a ratio (S/S') of an area S of the end surface of the wide portion to an area S' of the end surface of the narrow portion is greater than or equal to 1.2, and a hardness of the narrow portion is higher than or equal to 220 Hv.

As preferable modes of the above (1), the following modes can be exemplified.

(2) The area S' is greater than 0.5 $mm^2$.

(3) In the electrode tip of the above (1) or (2), a hardness of the end surface of the narrow portion is higher than or equal to 310 Hv.

(4) In the electrode tip, for a spark plug, of any of the above (1) to (3), on any cross-section cut at a plane including the axis, an entirety of the contour, representing the outer surface of the wide portion, from the boundary point between the narrow portion and the wide portion on the outer surface of the narrow portion and the wide portion, to the end point, on the boundary point side, among the two points representing the edge sides of the end surface of the wide portion, is positioned on the straight line connecting between the boundary point and the end point and/or outward of the straight line in the radial direction relative to the axis.

In accordance with a second aspect of the present invention, there is provided a spark plug that includes:

(5) a center electrode held at one end side in an axial bore that extends in an axial direction of an insulator, and a ground electrode having one end portion joined to a metallic shell provided on an outer circumference of the insulator, the ground electrode having the other end portion disposed such that a gap is formed between the other end portion and the center electrode, and, in the spark plug, the electrode tip of one of the above (1) to (4) is joined to at least one of the center electrode and the ground electrode by electric resistance welding, and a spark plug that includes:

(6) a center electrode held at one end side in an axial bore that extends in an axial direction of an insulator; and a ground electrode having one end portion joined to a metallic shell provided on an outer circumference of the insulator, the ground electrode having the other end portion disposed such that a gap is formed between the other end portion and the center electrode, and, in the spark plug, the electrode tip of one of the above (1) to (4) is joined to at least one of the center electrode and the ground electrode by laser welding.

The electrode tip contains Pt as a main component, and contains 7% by mass or more of Rh, and the total content of Pt and Rh is greater than or equal to 95% by mass. Therefore, the electrode tip is excellent in oxidation resistance and spark wear resistance. Further, since the electrode tip contains Pt as a main component, and contains 7% by mass or more of Rh, even when heat is applied during welding of the electrode tip to the electrode, the hardness of the electrode tip can be maintained so as to be higher than or equal to a certain hardness, thereby reducing deformation of the electrode tip. Further, the electrode tip includes the narrow portion and the wide portion, and at least a part of the contour representing the outer surface of the wide portion is positioned in a region which is outward, in the radial direction, of the straight line connecting between the boundary point and the end point, and which includes the straight line, on any cross-section cut at a plane including the axis, and the ratio (h/H×100) is greater than or equal to 35%, and the ratio (S/S') is greater than or equal to 1.2. Therefore, the electrode tip is excellent in peeling resistance with respect to the electrode while ignitability is maintained, and deformation of the narrow portion due to load being applied when the electrode tip is welded to the electrode is reduced and deformation of the wide portion due to heat and load being applied is reduced. Further, the hardness of the narrow portion is higher than or equal to 220 Hv. Therefore, deformation of the narrow portion due to load being applied when the electrode tip is welded to the electrode can be reduced. Therefore, according to the present invention, the electrode tip is excellent in oxidation resistance, spark wear resistance, and peeling resistance, and is less likely to be deformed when the electrode tip is welded to the electrode, and variation in dimension of the welded electrode tip can be reduced. Further, in the above configuration, the thickness, in the axial direction, of the wide portion can be maintained so as to be greater than or equal to a certain thickness, and the strength of the tip is improved not only through work hardening by plastic processing but also through solid solution strengthening by 7% by mass or more of Rh being contained. Therefore, in electric resistance welding, the wide portion need not be held, and the welding electrode is pressed against the end surface of the narrow portion and the welding at a relatively low current can be performed. Further, since the electrode tip has the wide portion, a great amount of heat for expanding the bottom portion of the tip to form the flange portion as described in Patent Document 3 need not be applied. Therefore, the electrode tip of the present invention allows a life span of a tool such as a welding electrode to be substantially improved, and allows cost for producing a spark plug to be reduced as compared to a conventional tip having a flange portion.

The spark plug has the electrode tip that is excellent in oxidation resistance, spark wear resistance, and peeling resistance, and that allows variation in dimension of the welded electrode tip to be reduced. Therefore, also when the spark plug is used under a high temperature environment and at a high spark discharge voltage, a desired performance can be exhibited over a long time period.

DETAILED DESCRIPTION OF THE PREFERRED EMBODIMENTS

Figure 1:
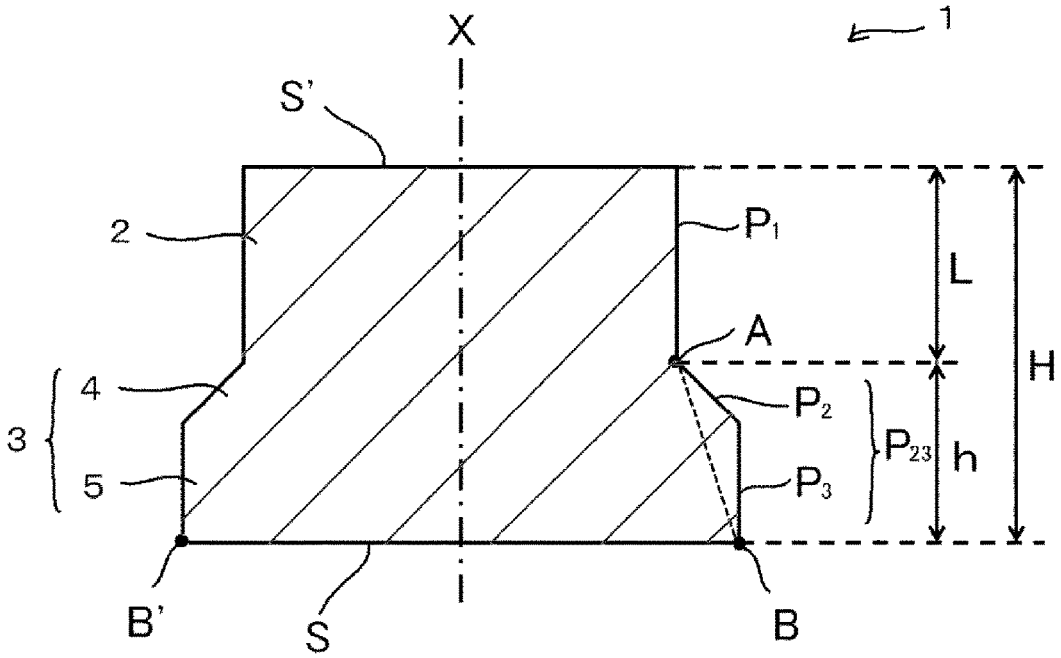
FIG. 1 is an explanatory view illustrating a cross-section, of an electrode tip according to one embodiment of the present invention, which is cut at a plane including an axis of the electrode tip.

An electrode tip for a spark plug according to the present invention is joined to at least one of a center electrode or a ground electrode of the spark plug, and used. The electrode tip for a spark plug according to the present invention contains Pt as a main component and contains 7% by mass or more of Rh, and the total content of Pt and Rh is greater than 95% by mass.

Since the electrode tip contains Pt as the main component, the electrode tip is excellent in both oxidation resistance and spark wear resistance. The electrode tip is formed from a Pt—Rh alloy that contains Pt and Rh. In the electrode tip formed from the Pt—Rh alloy, the greater the content of Rh is, the harder the electrode tip becomes by solid solution strengthening. As a method for enhancing the hardness of the electrode tip, various methods such as work hardening and solid solution strengthening may be used. Among them, the hardness of the electrode tip is preferably enhanced by at least the solid solution strengthening. That is, in a case where the hardness of the electrode tip is enhanced by work hardening, strain generated by the work hardening is returned by heat generated when the electrode tip is welded to the electrode, thereby reducing the hardness. Therefore, the hardness of the electrode tip is reduced when the electrode tip is welded to the electrode, whereby the electrode tip is likely to be deformed immediately after the welding. Meanwhile, in a case where the hardness of the electrode tip is enhanced by the solid solution strengthening, even if heat is applied during the welding, the hardness of the electrode tip can be maintained so as to be higher than or equal to a certain hardness. Thus, since the electrode tip contains 7% by mass or more of Rh, and the hardness is enhanced by at least the solid solution strengthening, deformation of the electrode tip immediately after the welding can be reduced. When the content of Rh is less than 7% by mass in the electrode tip, the hardness of the electrode tip after the welding cannot be maintained so as to be higher than or equal to the certain hardness. Thus, even when the electrode tip has a specific shape as described below, the electrode tip is likely to be deformed when the electrode tip is welded to the electrode. The content of Rh in the electrode tip is preferably less than 40% by mass from the standpoint that cracks are less likely to be generated in the welded electrode tip or in a melt portion formed by melting of the electrode tip and the electrode. The "main component" is a component having the highest mass proportion among the components contained in the electrode tip.

The total content of Pt and Rh is greater than or equal to 95% by mass in the electrode tip. The greater the total content is, the more advantageous the result is, and the total content thereof is more preferably 100% by mass. When the total content of Pt and Rh is greater than 95% by mass in the electrode tip, the electrode tip is excellent in oxidation resistance and spark wear resistance. When the total content is less than or equal to 95% by mass, the electrode tip is poor in oxidation resistance and spark wear resistance. In a case where the total content thereof is greater than 95% by mass, even when the electrode tip is used in a high temperature environment in which oxidation wear is likely to progress, the oxidation wear can be inhibited. Meanwhile, when the total content of Pt and Rh is greater than 95% by mass in the electrode tip, the greater the total content is, the greater the softness is. Therefore, when the electrode tip is welded to the electrode, deformation may easily occur. However, the electrode tip of the present invention has a specific shape as described below, and the strength of the tip is enhanced not only through work hardening by plastic processing but also through solid solution strengthening by Rh being contained. Therefore, while necessary durability in an actual engine can be assured, deformation during welding of the electrode tip to the electrode is reduced, and variation in dimension of the welded electrode tip can be reduced.

In a case where the electrode tip contains an element other than Pt and Rh, the element is preferably at least one selected from the element group A consisting of Ru, Ir, W, Re, Ni, and Co, and/or at least one selected from the element group B consisting of Y, Hf, Zr, rare earth elements, and elements in group 2 in the periodic table. In a case where an element of the element group A is contained in the electrode tip, the content thereof is preferably less than or equal to 5% by mass. In a case where an element of the element group B is contained in the electrode tip, the content thereof is preferably less than or equal to 0.1% by mass. The rare earth elements are La, Ce, Pr, Nd, Pm, Sm, Eu, Gd, Tb, Dy, Ho, Er, Tm, Yb, and Lu. The elements in group 2 in the periodic table are elements in group 2 according to IUPAC Nomenclature of Inorganic Chemistry, Recommendation 1990, and examples of the element in group 2 include Mg, Ca, Sr, and Ba. When the electrode tip contains an element other than Pt and Rh, oxidation resistance and spark wear resistance are reduced as compared to a case where 100% by mass of Pt and Rh is contained. However, when the electrode tip contains, as the element other than Pt and Rh, at least one element of the element group A in a ratio of 5% by mass or less, cost for an ingot can be reduced to be low. Further, reduction of oxidation resistance by an element other than Pt and Rh being contained, can be inhibited. Further, when the electrode tip contains, as the element other than Pt and Rh, at least one element of the element group B in a ratio of 0.1% by mass or less, cost for an ingot can be reduced to be low. Further, reduction of spark wear resistance by an element other than Pt and Rh being contained, can be inhibited.

The content of the elements contained in the electrode tip can be measured as follows. An electrode tip 1 is firstly cut at a plane including the axis of the electrode tip 1. At any plural locations, for example, five locations, near the center of the obtained cut surface, WDS (Wavelength Dispersive X-ray Spectrometer) analysis is performed by using FE-EPMA (Field Emission Electron Probe Micro Analysis: JXA-8500F manufactured by JEOL Ltd.) to measure a mass composition at each location. The arithmetic mean of the measured values having been obtained is calculated and the mean value is regarded as the content of the elements contained in the electrode tip 1.

The electrode tip for a spark plug according to the present invention is formed from the metal material described above, and is thus excellent in oxidation resistance and spark wear resistance. Further, the electrode tip has a specific shape and hardness as described below, is thus less likely to be peeled from the electrode to which the tip has been welded, and is less likely to be deformed when the electrode tip is welded to the electrode by electric resistance welding and/or laser welding. Therefore, the electrode tip welded thereto is less likely to be peeled from the electrode, and variation in dimension thereof is small.

First Embodiment

FIG. 1 is an explanatory view illustrating a cross-section, which is cut at a plane including the axis of an electrode tip, of the electrode tip which is an embodiment of an electrode tip for a spark plug according to the present invention. In FIG. 1, the upper direction on the surface of the sheet represents the front end direction of an axis X, and the lower direction on the surface of the sheet represents the rear end direction of the axis X. As shown in FIG. 1, the electrode tip 1 of the first embodiment includes: a narrow portion 2 that has a column-like shape and has the same cross-sectional shape in direction of the axis X; and a wide portion 3, adjacent to the narrow portion 2, in which a cross-sectional area in the direction orthogonal to the axis X is greater than that of the narrow portion 2. The wide portion 3 includes: a tapered portion 4 which is expanded from the end portion of the narrow portion 2 in a tapered manner to gradually increase the cross-sectional area in the direction orthogonal to the axis X; and a column-shaped portion 5 which is adjacent to the end portion, having the maximum cross-sectional area, of the tapered portion 4, has the same area as the maximum cross-sectional area, and has the same cross-sectional shape in direction of the axis X. When the electrode tip 1 is joined to the electrode, the end surface of the wide portion 3 is joined to the electrode, and the end surface of the narrow portion 2 serves as a discharge surface. The electrode tip 1 includes the narrow portion 2 and the wide portion 3. Therefore, while ignitability is maintained, peeling resistance with respect to the electrode can be improved. In the electrode tip 1 of the present embodiment, the cross-sectional shape in the direction orthogonal to the axis X is circular in each of the narrow portion 2, the tapered portion 4, and the column-shaped portion 5. The cross-sectional shape may be other than the circular shape, and may be, for example, a polygonal shape such as a triangular shape, a quadrangular shape, a hexagonal shape, or an ellipsoidal shape.

Figure 2:
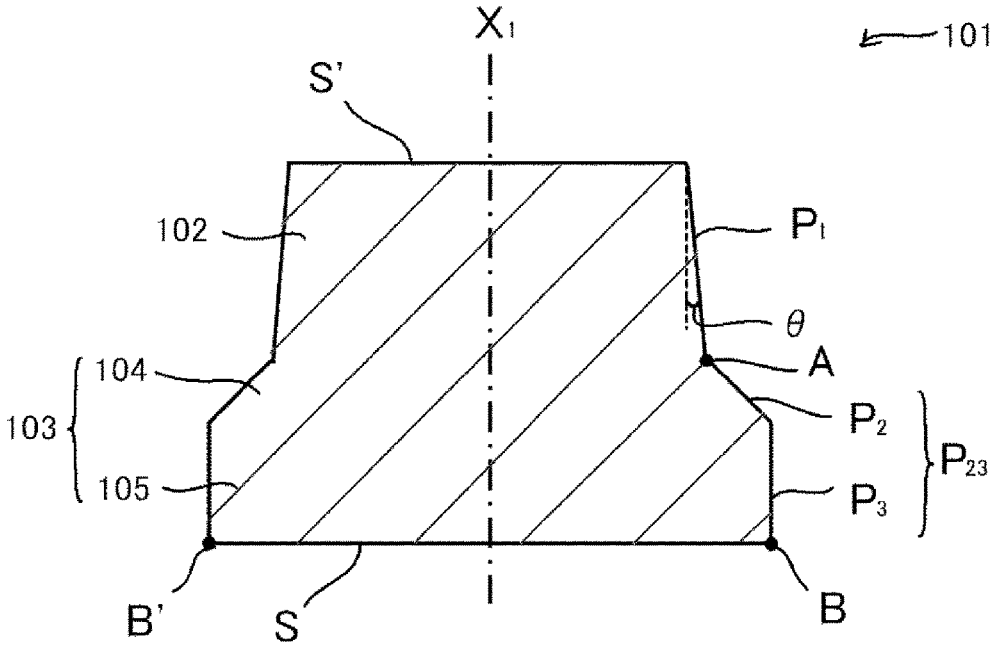
FIG. 2 is an explanatory view illustrating a cross-section, of an electrode tip according to another embodiment of the present invention, which is cut at a plane including an axis of the electrode tip.

The narrow portion 2 has the same cross-sectional shape in direction of the axis X. In the present embodiment, the cross-sectional shape of the narrow portion 2 is circular, and the narrow portion 2 has the same cross-sectional area in direction of the axis X. The narrow portion of the present embodiment is not limited particularly to a portion having the same cross-sectional area in direction of the axis X. The narrow portion may include a portion in which the cross-sectional area is increased from the end surface of the narrow portion toward the rear end side such that the taper angle is less than or equal to 3°. That is, for example, in the narrow portion of the present invention, as shown in FIG. 2, an angle θ between the axis $X_1$, and a contour $P_1$ representing a side surface of a narrow portion 102 is less than or equal to 3° on any cross-section obtained by an electrode tip 101 being cut at a plane including the axis $X_1$. In a case where the contour $P_1$ is a curved line, the angle θ between the axis $X_1$ and the tangent line at any point on the curved line is less than or equal to 3°.

As shown in FIG. 1, in the electrode tip 1, on any cross-section which is cut at a plane including the axis X, a contour $P_{23}$ representing an outer surface, of the wide portion 3, from a boundary point A between the narrow portion 2 and the wide portion 3 on an outer surface of the narrow portion 2 and the wide portion 3, to an end point B, on the boundary point A side, among two points B, B' representing edge sides of the end surface of the wide portion 3 is outward of a straight line AB connecting between the boundary point A and the end point B, in the radial direction relative to the axis X. In a case where the contour $P_{23}$ is outward of the straight line AB in the radial direction relative to the axis X, when the electrode tip 1 is welded to the electrode, the wide portion 3 is less likely to be deformed. In the electrode tip of the present invention, at least a part of the contour may be on the straight line and/or outward of the straight line in the radial direction relative to the axis X, whereby the deformation of the wide portion can be reduced. As in the electrode tip 1 of the present embodiment, when the entirety of the contour $P_{23}$ is outward of the straight line AB in the radial direction relative to the axis X, deformation of the wide portion 3 can be further reduced.

The boundary point A is a point on the rear end side of a generating line $P_1$ of the narrow portion 2. That is, the generating line $P_1$ is a straight line parallel to the axis X, and a generating line $P_2$ of the tapered portion 4 is a straight line that forms a taper angle greater than 3°. Therefore, the boundary point A is a point of intersection of the generating line $P_1$ and the generating line $P_2$. As shown in (a) and (b) of FIG. 3, in a case where a portion near the boundary between a narrow portion 202 and a tapered portion 204 is shaped in the form of a curved line, a region in which an angle θ between: the axis $X_2$; and the tangent line at any point on the contour representing an outer surface of the narrow portion 202 and the tapered portion 204 is less than or equal to 3° is the narrow portion 202, on any cross-section obtained by the electrode tip 201 being cut at a plane including the axis $X_2$. Therefore, a point, near the boundary between the narrow portion 202 and the tapered portion 204, at which the angle θ is 3° is the boundary point A.

Figure 3A:
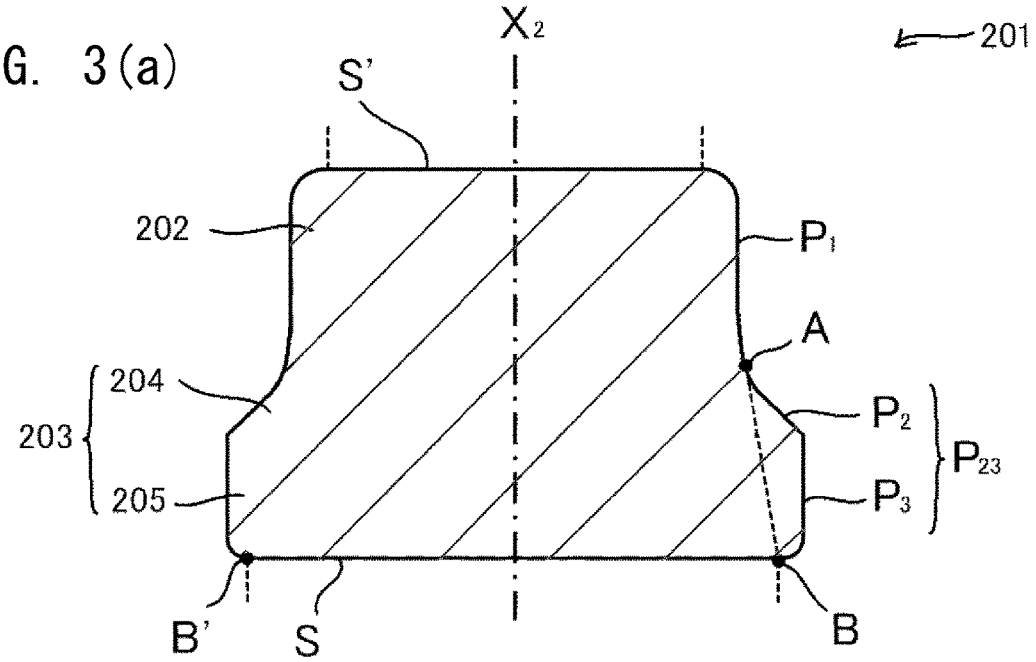
FIG. 3(*a*) is an explanatory view illustrating a cross-section, of an electrode tip according to another embodiment of the present invention, which is cut at a plane including an axis of the electrode tip, and FIG. 3(*b*) is an enlarged explanatory view illustrating, in an enlarged manner, a cross-section of a main portion near a boundary point of the electrode tip shown in (a).
Figure 3B:
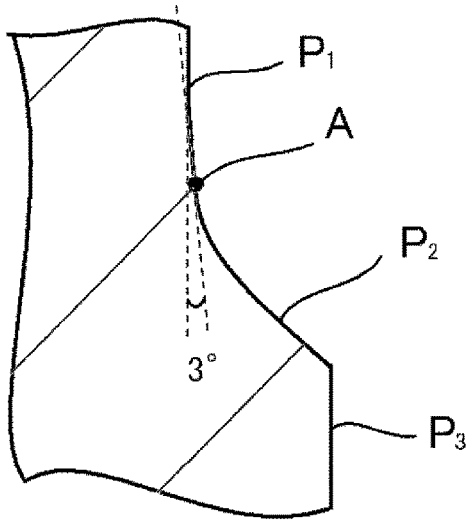
Figure 4:
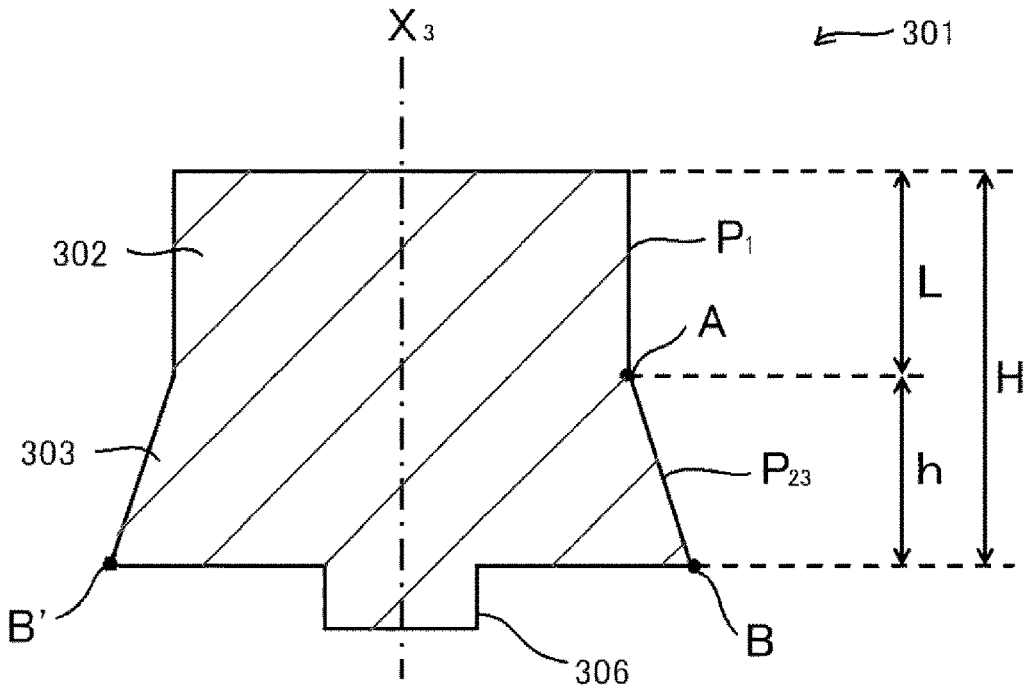
FIG. 4 is an explanatory view illustrating a cross-section, of an electrode tip according to another embodiment of the present invention, which is cut at a plane including an axis of the electrode tip.

The end point B is the end point of the straight line representing the end surface of the wide portion 3 in FIG. 1. In the first embodiment, the wide portion 3 is a column-shaped member having the same cross-sectional shape and the same cross-sectional area in direction of the axis X, and the generating line $P_3$ of the wide portion 3 is a straight line in FIG. 1. Therefore, the end point B is also a point on the rear end side, in direction of the axis X, of the generating line $P_3$ of the wide portion 3. In the present invention, at the rear end corner portion of a wide portion 203, the electrode tip may have a round portion in which the radius of curvature is less than or equal to 0.1 mm, as shown in FIG. 3. In a case where the wide portion 203 has the round rear end corner portion, the end point B is the end point of the straight line representing the end surface of the wide portion 203, and the curved line portion is not included in the end surface of the wide portion 203. The electrode tip of the present invention may have a projection 306 that projects rearward from the end surface of a wide portion 303, as shown in FIG. 4. The projection 306 may be provided so as to form, when an electrode tip 301 is welded to the electrode by electric resistance welding, a melt portion by concentrating current on the projection 306, and melting and mixing the electrode tip 301 and the electrode in a wide range around the projection 306, whereby the electrode tip 301 and the electrode are assuredly joined to each other. As shown in FIG. 4, the projection 306 typically has a diameter that is less than the diameter of a narrow portion 302, for example, has the diameter of 0.6 mm or less. The electrode tip of the present invention allows a desired effect to be obtained regardless of whether or not the projection is provided. Therefore, in a case where the electrode tip 301 has the projection 306 as shown in FIG. 4, on the assumption that the projection 306 is not provided, the surface on which the projection 306 is provided is regarded as a straight line. Thus, the end point B is regarded as the end point of the straight line.

In the electrode tip 1, as shown in FIG. 1, when H represents a tip height which is a distance from the end surface of the narrow portion 2 to the end surface of the wide portion 3, and h represents a wide portion height which is a distance from the boundary point A to the end surface of the wide portion 3, a ratio (h/H×100) of the wide portion height h to the tip height H is greater than or equal to 35%. When the ratio is greater than or equal to 35% in the electrode tip 1, deformation of the wide portion 3 due to load being applied in the case of the electrode tip 1 being welded to the electrode, and deformation of the wide portion 3 due to heat generation in the case thereof, can be reduced. Further, the greater the ratio is, the lower a narrow portion height L which is the height of the narrow portion 2 is. The lower the narrow portion height L is, the less deformation of the narrow portion 2 due to load being applied immediately before the electrode tip 1 is welded can be. When the ratio is less than 35% in the electrode tip 1, the less the ratio is, the thinner the wide portion 3 is, and, when the electrode tip 1 is welded to the electrode, the wide portion 3 is more likely to be deformed or a crack is more likely to be generated therein. As a result, a strength with which the electrode tip 1 is joined to the electrode is reduced, and a yield is also reduced. In a case where the joining strength is likely to be reduced due to the wide portion being thin, a welding electrode having such a specific shape that allows a load to be applied directly to the wide portion in the axial direction during electric resistance welding may be used. However, the welding electrode having the specific shape is very costly. Further, the electrode tip is held at a position near the welded portion, whereby the life span of the welding electrode is reduced. As a result, the spark plug to which the electrode tip 1 is joined is high-priced. Further, in a case where load is applied directly to the wide portion, load concentrates on only the wide portion, and the wide portion is thus more likely to be deformed and overheated, whereby spatters may be generated and the dimension of the welded tip may be unstable. Further, in a case where load is applied directly to the wide portion, load is not applied directly to the center portion of the surface to be welded, that is, a portion obtained by the end surface of the narrow portion being projected onto the surface to be welded in the axial direction. The area of this portion occupies most of the area to be welded, whereby welding strength may not become sufficient.

The narrow portion height L is preferably greater than or equal to 0.25 mm, and more preferably greater than or equal to 0.3 mm. When the narrow portion height L is greater than or equal to 0.25 mm, particularly when the narrow portion height L is greater than or equal to 0.3 mm, ignitability of the spark plug having the electrode tip 1 can be improved. Therefore, when the ratio is greater than or equal to 35% and the narrow portion height L is greater than or equal to 0.25 mm in the electrode tip 1, deformation of the wide portion 3 due to load being applied in the case of the electrode tip 1 being welded to the electrode and deformation of the wide portion 3 due to heat generation in the case thereof, can be reduced, and ignitability of the spark plug to which the electrode tip 1 is joined can be simultaneously improved.

In the electrode tip 1, a ratio (S/S') of an area S of the end surface of the wide portion 3 to an area S' of the end surface of the narrow portion 2 is greater than or equal to 1.2. Further, the ratio is preferably not greater than 2.2. When the ratio (S/S') is greater than or equal to 1.2, the wide portion 3 is less likely to be deformed when the electrode tip 1 is welded to the electrode, and variation in dimension by the welding is reduced. Further, the electrode tip 1 becomes excellent in peeling resistance while maintaining ignitability. When the ratio (S/S') is less than 1.2, the wide portion 3 is more likely to be deformed when the electrode tip 1 is welded to the electrode, and variation in dimension by the welding is increased. Further, the electrode tip 1 is likely to be joined so as to be tiled, and ignitability or peeling resistance may be deteriorated. When the ratio (S/S') is not greater than 2.2, it is advantageous in that processing of a header is facilitated to facilitate manufacturing when the electrode tip 1 is manufactured.

When the ratio (S/S') is greater than or equal to 1.2, the area S' is preferably greater than 0.5 $mm^2$ The greater the area S' is, the greater the area S is and the greater the volume of the electrode tip 1 is. The greater the volume of the electrode tip 1 is, the greater an amount of heat is in the case of the electrode tip 1 being welded to the electrode by electric resistance welding. Therefore, when the electrode tip 1 is welded to the electrode by electric resistance welding, the electrode tip 1 is likely to be deformed. However, the electrode tip 1 has the specific shape and hardness as described above, and the closer the size of the electrode tip is to the size by which the electrode tip is likely to be deformed by electric resistance welding, the greater the effect of reducing the deformation is.

The area S' and the area S are the areas of the end surfaces, that is, flat surfaces of the narrow portion 2 and the wide portion 3, respectively. In the electrode tip of the present invention, a round portion having a radius of curvature of 0.1 mm or less may be provided at each of the front end corner portion of the narrow portion 202 and the rear end corner portion of the wide portion 203, as shown in FIG. 3. When the narrow portion 202 has the round front end corner portion, the area S' is an area of the straight line portion representing the flat surface of the narrow portion 202 other than the curved line portion representing the round portion. Similarly, when the wide portion 203 has the round rear end corner portion, the area S is an area of the straight line portion representing the flat surface of the wide portion 203 other than the curved line portion representing the round portion. When the electrode tip 301 has the projection 306 as shown in FIG. 4, the area S is an area of a flat surface obtained on the assumption that the projection 306 is not provided and the surface to which the projection 306 is joined is the flat surface.

A hardness of the narrow portion 2 is higher than or equal to 220 Hv. That is, the hardness of the inner portion of the narrow portion 2 is higher than or equal to 220 Hv, and the hardness of the end surface of the narrow portion 2 is higher than or equal to 220 Hv. Further, it is preferable that the hardness of the inner portion of the narrow portion 2 is higher than or equal to 220 Hv, and the hardness of the end surface of the narrow portion 2 is higher than or equal to 310 Hv. Further, it is more preferable that the hardness of the inner portion of the narrow portion 2 is higher than or equal to 220 Hv, and less than 310 Hv, and the hardness of the end surface of the narrow portion 2 is higher than or equal to 310 Hv. When the hardness of the narrow portion 2 is higher than or equal to 220 Hv, deformation of the narrow portion 2 due to load being applied immediately before the electrode tip 1 is welded to the electrode, can be reduced. Further, when the hardness of the end surface of the narrow portion 2 is higher than or equal to 310 Hv, deformation of the narrow portion 2 due to load being applied immediately before the electrode tip 1 is welded to the electrode can be further reduced. Further, when the hardness of the inner portion of the narrow portion 2 is higher than or equal to 220 Hv, and less than 310 Hv, and the hardness of the end surface of the narrow portion 2 is higher than or equal to 310 Hv, generation of cracks in the narrow portion 2 during welding can be reduced.

The hardness of each of the inner portion and the end surface of the narrow portion 2 can be adjusted through, for example, solid solution strengthening, and work hardening by plastic processing. Further, the hardness of the end surface of the narrow portion 2 can be adjusted so as to be higher than the hardness of the inner portion of the narrow portion 2 by shearing such as shear cutting during cutting of a round bar member in a process of manufacturing the electrode tip 1 as described below. That is, the hardness can be adjusted so as to be a desired hardness by changing, as appropriate, conditions of heat treatment performed before and after the shearing, a processing speed of shearing of the round bar member, or the like. Meanwhile, the hardness of the end surface of the narrow portion 2 is likely to be lower than the hardness of the inner portion of the narrow portion 2 when wire cutting is performed. Therefore, the hardness needs to be adjusted so as not to be less than or equal to 220 Hv by changing, as appropriate, types of lubricant and binder, an amount of the lubricant, a processing speed, the diameter of the round bar member, or the like. Further, when a cut member obtained after the round bar member has been cut is subjected to plastic processing to arrange the outer shape, processing conditions of the plastic processing, determination as to whether or not heat treatment is to be performed, the conditions of the heat treatment in the case of the heat treatment being to be performed, and the like are changed as appropriate, whereby the hardness of each of the inner portion and the end surface of the narrow portion 2 can be adjusted. Further, the end surface of the narrow portion 2 can be adjusted so as to have a hardness higher than the inner portion of the narrow portion 2 also by using shot peening.

The hardness is measured by using a Vickers hardness tester at a load of 1N and at a retention time of 10 seconds in compliance with the standard of JIS Z 2244. A region in which the hardness of the end surface of the narrow portion 2 is measured is any plural locations, for example, five locations near the center of the end surface as seen in the direction of the axis X. Further, for the hardness of the inner portion of the narrow portion 2, after the hardness of the end surface of the narrow portion 2 has been measured, the electrode tip 1 is cut at a plane including the axis X. On the cut surface, a region in which the hardness of the inner portion of the narrow portion 2 is measured is any plural locations, for example, five locations near the center of the narrow portion on the cut surface. The arithmetic mean of the measured hardness values is calculated for each of the inner portion and the end surface, and the respective obtained mean values are regarded as the hardness of the inner portion of the narrow portion 2 and the hardness of the end surface of the narrow portion 2.

The electrode tip 1 is manufactured, for example, in the following manner. Metal components in which the content of each component is in the above-described range are blended to prepare raw material powder. The raw material powder is subjected to arc melting to form an ingot. The ingot is hot-forged into a bar member. Next, the bar member is subjected to rolling with a grooved roll a plurality of times, subjected to swaging as appropriate, and subjected to drawing by die drawing, to obtain a round bar member having a circular cross-sectional shape, and the round bar member is cut so as to have a predetermined length. When the cross-sectional shape of the electrode tip is other than a circular shape, e.g. the cross-sectional shape thereof is quadrangular, the ingot is subjected to drawing by using a quadrangular die, and processed to be a quadrangular member. The quadrangular member is cut so as to have a predetermined length, thereby forming, for example, a quadrangular bar having a quadrangular cross-sectional shape.

The round bar member can be cut by, for example, shearing such as shear cutting, or wire cutting. When the round bar member is cut by shearing such as shear cutting, the round bar member is subjected to plastic processing, whereby the hardness of the cut surface is easily enhanced, and the hardness of the end surface of the electrode tip 1 can be easily adjusted so as to have a desired hardness. When the round bar member is cut by wire cutting, since the hardness is likely to be reduced due to heat by friction, types of lubricant and binder, an amount of the lubricant, a processing speed, and the diameter of the round bar member, and the like are adjusted as appropriate, whereby the hardness of the end surface of the electrode tip 1 is adjusted so as to be higher than or equal to 220 Hv.

Next, the outer shape of the almost column-shaped cut member obtained by the round bar member being cut, is arranged so as to have a desired shape. The shaping or forming of the cut member may be performed by, for example, a method using cutting or a method using a die. Thus, the electrode tip 1 is manufactured.

The electrode tips 1, 101, and 201 are each joined to at least one of the center electrode and the ground electrode of the spark plug, and used. The electrode tip 1 has oxidation resistance, spark wear resistance, and peeling resistance, and the electrode tip 1 is less likely to be deformed when the electrode tip 1 is welded to the electrode, so that variation in dimension of the welded electrode tip 1, in particular, variation in height thereof is small. Further, in the electrode tips 1, 101, and 201, the generating line $P_1$ of each of the narrow portions 2, 102, and 202, and the generating line $P_3$ of each of the wide portions 3, 103, and 203 are parallel to the axes X, $X_1$, and $X_2$, respectively. Therefore, in a case where the position is confirmed from above the discharge surface by a camera in order to align the center of each of the electrode tips 1, 101, 201 with the center of the rotational mechanism of the welding equipment when the laser welding is performed, the discharge surface is easily detected. Further, when the tip is conveyed to a predetermined position before welding, the tip can be easily held by a chuck or the like. Further, an amount of precious metal in a melt portion formed when laser welding is performed is increased as compared to a second embodiment described below. Therefore, peeling resistance is advantageous. Further, in a case where the electrode tips 1, 101, and 201 are manufactured, processing is facilitated when the wide portions 3, 103, and 203 are formed by plastic processing as compared to a third embodiment described below.

Second Embodiment

FIG. 4 is an explanatory view illustrating a cross-section, which is cut at a plane including the axis of an electrode tip, of the electrode tip which is another embodiment of an electrode tip for a spark plug according to the present invention. The electrode tip 301 of the present embodiment is the same as the electrode tip 1 of the first embodiment except that, on any cross-section cut at a plane including an axis $X_3$, a contour $P_{23}$ representing an outer surface, of the wide portion 303, from a boundary point A between the narrow portion 302 and the wide portion 303 on an outer surface of the narrow portion 302 and the wide portion 303, to an end point B, on the boundary point A side, among two points B, B' representing edge sides of the end surface of the wide portion 303 is on a straight line AB connecting between the boundary point A and the end point B, and the projection 306 is provided so as to project rearward from the end surface of the wide portion 303. In the electrode tip 301 of the present embodiment, since the contour $P_{23}$ is on the straight line AB, when the electrode tip 301 is welded to the electrode, the wide portion 303 is less likely to be deformed. As a result, variation in dimension of the welded electrode tip is small. Further, the electrode tip 301 of the present embodiment has the projection 306 on the end surface of the wide portion 303. Therefore, the electrode tip 301 and the electrode can be assuredly joined to each other. As a result, peeling resistance can be made still more excellent.

Third Embodiment

Figure 5:
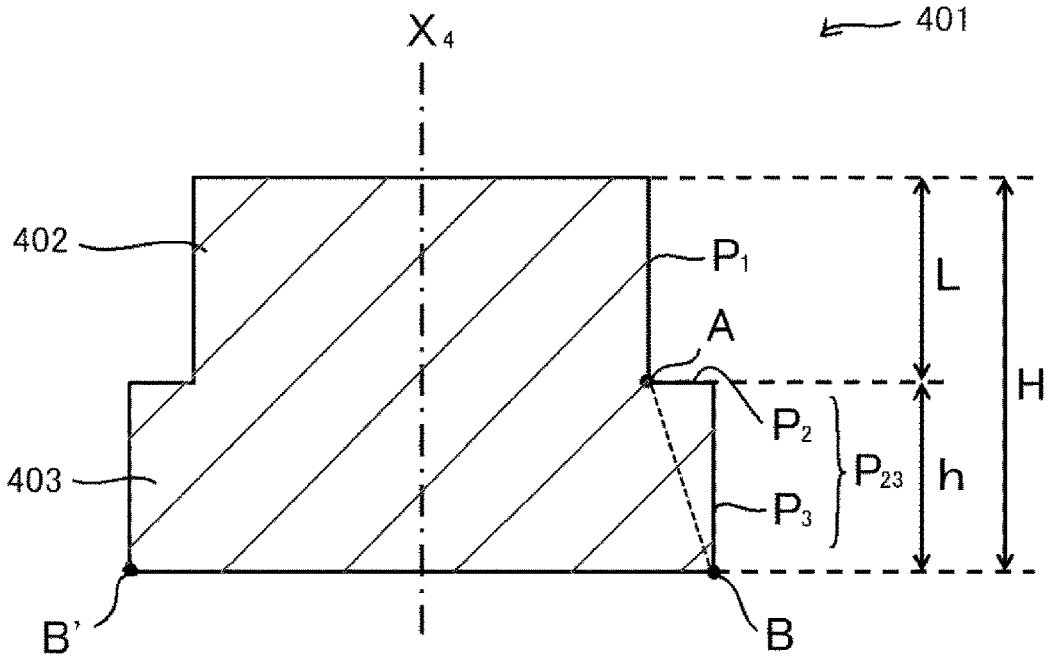
FIG. 5 is an explanatory view illustrating a cross-section, of an electrode tip according to another embodiment of the present invention, which is cut at a plane including an axis of the electrode tip.

FIG. 5 is an explanatory view illustrating a cross-section, which is cut at a plane including the axis of an electrode tip, of the electrode tip which is another embodiment of an electrode tip for a spark plug according to the present invention. An electrode tip 401 of the present embodiment is the same as the electrode tip 1 of the first embodiment except that, in the direction orthogonal to an axis $X_4$, the cross-sectional area of a wide portion 403 is greater than the cross-sectional area of a narrow portion 402, and the wide portion 403 has such a column-like shape as to have the same cross-sectional shape and cross-sectional area in the direction of the axis $X_4$. Since the electrode tip 401 of the present embodiment has the wide portion 403 having the column-like shape, when the electrode tip 401 is welded to the electrode, the wide portion 403 is less likely to be deformed. As a result, variation in dimension of the welded electrode tip is small.

Fourth Embodiment

Figure 6:
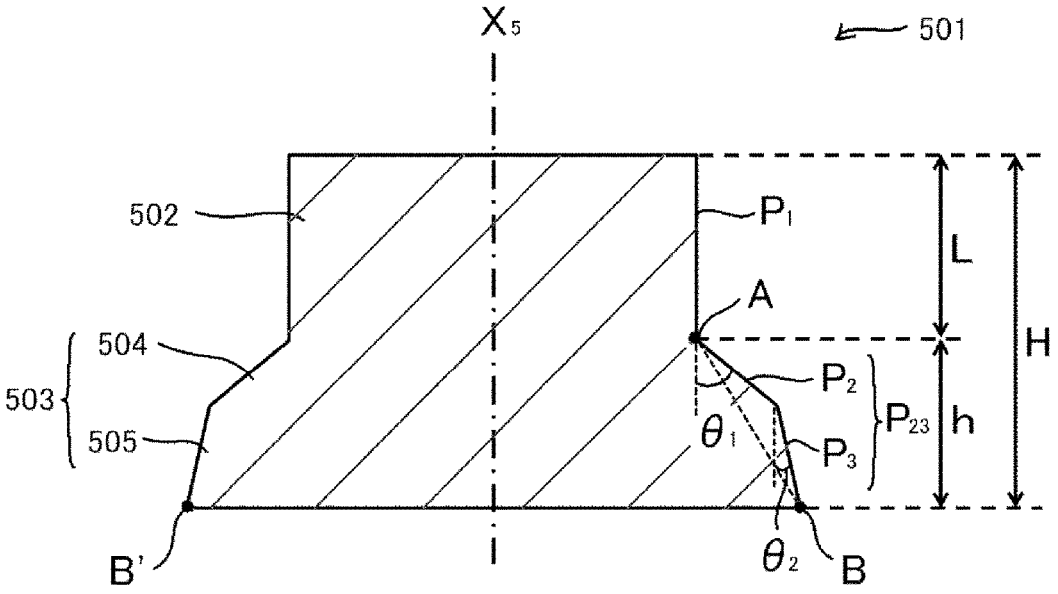
FIG. 6 is an explanatory view illustrating a cross-section, of an electrode tip according to another embodiment of the present invention, which is cut at a plane including an axis of the electrode tip.

FIG. 6 is an explanatory view illustrating a cross-section, which is cut at a plane including the axis of an electrode tip, of the electrode tip which is another embodiment of an electrode tip for a spark plug according to the present invention. An electrode tip 501 of the present embodiment is the same as the electrode tip 1 of the first embodiment except that a wide portion 503 has: a tapered portion 504 that is expanded from the end portion of a narrow portion 502 in a tapered manner to gradually increase the cross-sectional area in the direction orthogonal to an axis $X_5$; and a second tapered portion 505 that is expanded from the end portion, having the maximum cross-sectional area, of the tapered portion 504 in a tapered manner by a taper angle $\theta_2$ smaller than a taper angle $\theta_1$ of the tapered portion 504, to gradually increase the cross-sectional area in the direction orthogonal to the axis $X_5$. In the electrode tip 501 of the present embodiment, the wide portion 503 is formed by the tapered portion 504 and the second tapered portion 505, and the contour $P_{23}$ representing the outer surface of the wide portion 503 from the boundary point A to the end point B is located outward of the straight line AB in the radial direction, whereby the wide portion 503 is less likely to be deformed when the electrode tip 501 is welded to the electrode. As a result, variation in dimension of the welded electrode tip is small.

Figure 7:
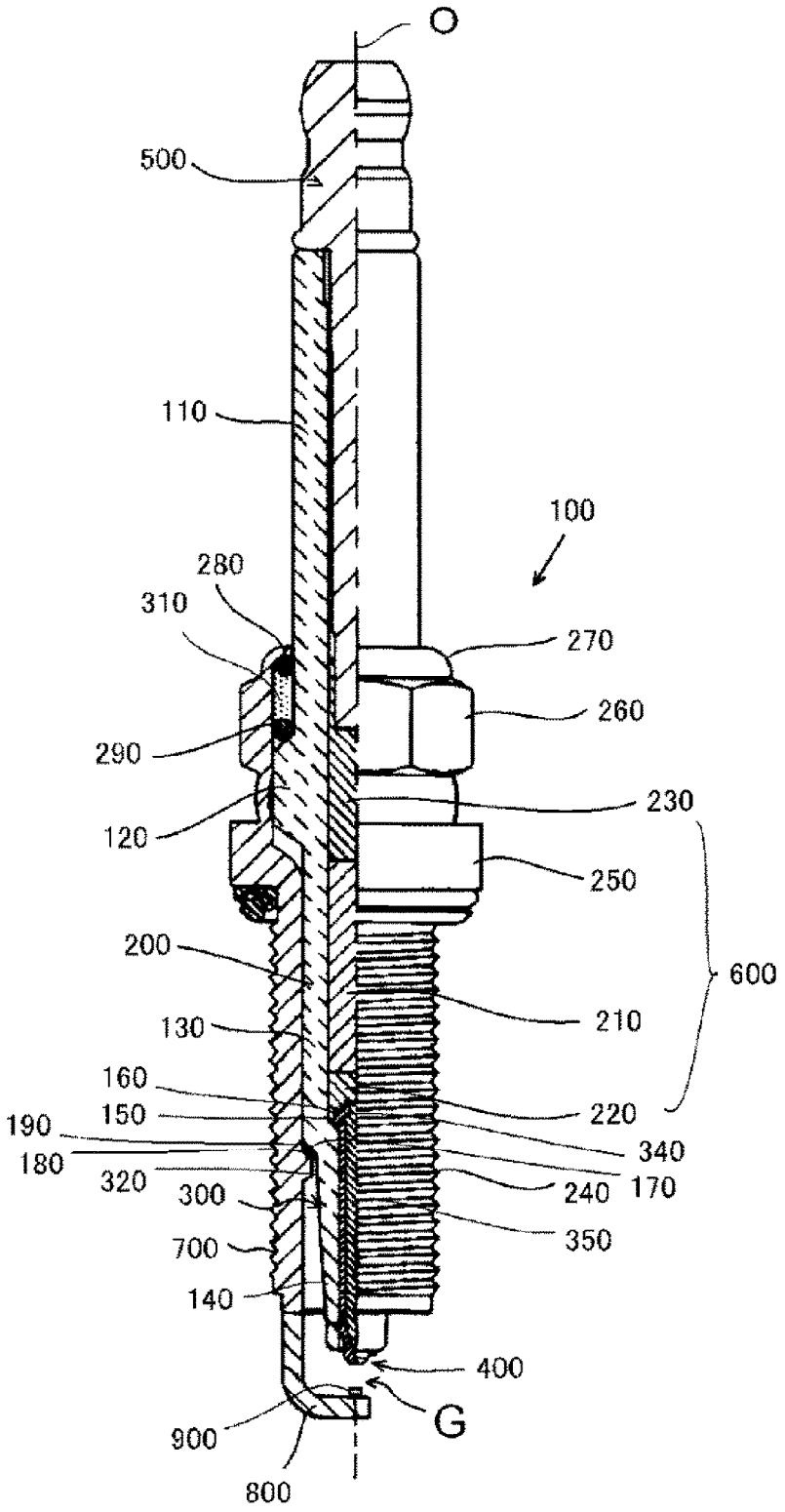
FIG. 7 is an explanatory view illustrating a part of a cross-section of a spark plug which is an embodiment of a spark plug according to the present invention.

An embodiment of a spark plug having the electrode tip for a spark plug according to the present invention will be described below. FIG. 7 is an explanatory view entirely illustrating a part of the cross-section of a spark plug 100 which is an embodiment of a spark plug according to the present invention. In FIG. 7, the lower direction on the surface of the sheet represents the front end direction of an axis O, and the upper direction on the surface of the sheet represents a rear end direction of the axis O.

As shown in FIG. 7, the spark plug 100 includes: an insulator 300 having an almost cylindrical shape and having an axial bore 200 that extends in the direction of the axis O; a center electrode 400 having an almost bar-like shape and provided on the front end side in the axial bore 200; a metal terminal 500 provided on the rear end side in the axial bore 200; a connection portion 600 that electrically connects between the center electrode 400 and the metal terminal 500 in the axial bore 200; a metallic shell 700 that has an almost cylindrical shape and holds the insulator 300; and a ground electrode 800 arranged so as to have one end portion joined to the front end portion of the metallic shell 700 and have the other end portion opposing the center electrode 400 with a gap G formed between the other end portion of the ground electrode 800, and the center electrode 400. The ground electrode 800 has an electrode tip 900 formed on the side surface of the front end portion thereof. The electrode tip 900 is formed by, for example, the electrode tip 1 described above being joined to the ground electrode 800 by electric resistance welding and/or laser welding.

The insulator 300 has the axial bore 200 that extends in the direction of the axis O, and has an almost cylindrical shape. Further, the insulator 300 includes a rear trunk portion 110, a large diameter portion 120, a front trunk portion 130, and a leg portion 140. The rear trunk portion 110 stores the metal terminal 500 and insulates the metal terminal 500 and the metallic shell 700 from each other. The large diameter portion 120 projects radially outward on the side forward of the rear trunk portion 110. The front trunk portion 130 stores the connection portion 600 on the side forward of the large diameter portion 120, and has an outer diameter less than that of the large diameter portion 120. The leg portion 140 stores the center electrode 400 on the side forward of the front trunk portion 130, and has an outer diameter and an inner diameter that are less than the front trunk portion 130. A ledge portion 150 is provided on an inner circumferential surface between the front trunk portion 130 and the leg portion 140. A flange portion 160, described below, of the center electrode 400 is disposed so as to contact with the ledge portion 150, to fix the center electrode 400 in the axial bore 200. A stepped portion 170 is provided on the outer circumferential surface between the front trunk portion 130 and the leg portion 140. A tapered portion 180, described below, of the metallic shell 700 contacts with the stepped portion 170 through a sheet packing 190, to fix the insulator 300 to the metallic shell 700. The insulator 300 is fixed to the metallic shell 700 in a state where the forward end portion of the insulator 300 projects from the front end surface of the metallic shell 700. The insulator 300 is desirably formed from a material having mechanical strength, thermal strength, and electrical strength. Examples of such a material include a ceramic sintered body which contains alumina as a main material.

In the axial bore 2 of the insulator 300, the center electrode 400 is provided on the front end side, and the metal terminal 500 is provided on the rear end side, and the connection portion 600 that fixes the center electrode 400 and the metal terminal 500 in the axial bore 200 and that electrically connects therebetween is provided between the center electrode 400 and the metal terminal 500. The connection portion 600 includes: a resistor 210 for reducing propagation noise; a first seal body 220 provided between the resistor 210 and the center electrode 400; and a second seal body 230 provided between the resistor 210 and the metal terminal 500. The resistor 210 is formed by a composition containing glass powder, nonmetal conductive powder, metal powder, and the like being sintered, and the resistance value thereof is typically higher than or equal to 100Ω. The first seal body 220 and the second seal body 230 are each formed by a composition containing glass powder, metal powder, and the like being sintered, and the resistance value thereof is typically lower than or equal to 100 mΩ. The connection portion 600 of the present embodiment is formed by the resistor 210, the first seal body 220, and the second seal body 230. However, the connection portion 600 may be formed by at least one of the resistor 210, the first seal body 220, and the second seal body 230.

The metallic shell 700 has an almost cylindrical shape, and has the insulator 300 inserted therein, thereby holding the insulator 300. A screw portion 240 is formed on the outer circumferential surface of the forward end portion of the metallic shell 700. The spark plug 100 is mounted to a cylinder head of a not-illustrated internal combustion engine by using the screw portion 240. The metallic shell 700 has a flange-shaped gas seal portion 250 on the side rearward of the screw portion 240, has, on the side rearward of the gas seal portion 250, a tool engagement portion 260 for engagement of a tool such as a spanner or a wrench, and has a crimping portion 270 on the side rearward of the tool engagement portion 260. Ring-shaped packings 280, 290 and a talc 310 are disposed in an annular space formed between the inner circumferential surfaces of the crimping portion 270 and the tool engagement portion 260, and the outer circumferential surface of the insulator 300, and the insulator 300 is fixed relative to the metallic shell 700. The front end portion of the inner circumferential surface of the screw portion 240 is disposed so as to form a space relative to the leg portion 140, and the tapered portion 180, provided on the side rearward of a projection 320 that projects radially inward, having the diameter expanded in a tapered manner, and the stepped portion 170 of the insulator 300 contact with each other through the annular sheet packing 190. The metallic shell 700 can be formed from a conductive steel material such as low-carbon steel.

The metal terminal 500 is a terminal for applying a voltage from the outside to the center electrode 400 so as to cause spark discharge between the center electrode 400 and the ground electrode 800, and the metal terminal 500 is inserted into the axial bore 200 and fixed by the second seal body 230 so as to expose a part thereof from the rear end side of the insulator 300. The metal terminal 500 can be formed from a metal material such as low-carbon steel.

The center electrode 400 has: a rear end portion 340 that contacts with the connection portion 600; and a rod-shaped portion 350 that extends toward the front end side from the rear end portion 340. The rear end portion 340 has the flange portion 160 that projects radially outward. The flange portion 160 is disposed so as to contact with the ledge portion 150 of the insulator 300, and the first seal body 220 is filled between the inner circumferential surface of the axial bore 200 and the outer circumferential surface of the rear end portion 340. Thus, the center electrode 400 is fixed in the axial bore 200 of the insulator 300 in a state where the front end of the center electrode 400 projects from the front end surface of the insulator 300, whereby the center electrode 400 is insulated from and held by the metallic shell 700. The rear end portion 340 and the rod-shaped portion 350 of the center electrode 400 can be formed from a known material used for the center electrode 400, such as Ni or a Ni alloy containing Ni as a main component. The center electrode 400 may be formed by: an outer layer formed from a Ni alloy or the like; and a core portion formed from a material having a higher coefficient of thermal conductivity than the Ni alloy, and formed so as to be concentrically embedded in an axial portion within the outer layer. Examples of the material of the core portion include Cu, a Cu alloy, Ag, an Ag alloy, and pure Ni.

The ground electrode 800 is formed so as to have, for example, almost a prismatic shape. The ground electrode 800 has one end portion joined to the front end portion of the metallic shell 700, and is bent so as to be almost L-shaped in the intermediate portion, and has the other end portion that opposes the front end portion of the center electrode 400 with the gap G formed between the other end portion and the front end portion. The ground electrode 800 can be formed from a known material used for the ground electrode 800 such as Ni or a Ni alloy. Further, similarly to the center electrode 400, the ground electrode may have, in the axial portion, a core portion formed from a material having a higher coefficient of thermal conductivity than the Ni alloy. In the present embodiment, the gap G represents the shortest distance between the front end surface of the electrode tip 900 formed in the ground electrode 800, and the front end surface, of the center electrode 400, opposing the front end surface of the electrode tip 900, and the gap G is typically set to be 0.3 to 1.5 mm. The electrode tip 900 may be provided on at least one of the opposing front end portions of the ground electrode 800 and the center electrode 400. For example, in a case where the electrode tips are provided in both of the ground electrode 800 and the center electrode 400, the shortest distance between the opposing surfaces of the electrode tip 900 provided in the ground electrode 800 and the electrode tip provided in the center electrode 400 is the spark discharge gap G.

The spark plug 100 is manufactured in, for example, the following manner.

The center electrode 400 and/or the ground electrode 800 can be produced, for example, by: preparing a molten metal of an alloy having a desired composition by using a vacuum melting furnace; performing drawing processing or the like; and performing adjustment to a predetermined shape and a predetermined dimension as appropriate. As the center electrode 400, a center electrode 400 having a core portion within an outer layer is formed by: inserting, into an outer member formed in a cup shape and formed from a Ni alloy or the like, an inner member formed from a Cu alloy or the like having a higher coefficient of thermal conductivity than that of the outer member; and performing plastic processing such as extruding. The ground electrode 800 of the spark plug 100 of the embodiment is formed from one kind of material, but similarly to the center electrode 400, the ground electrode 800 may be formed by an outer layer and a core portion provided so as to be embedded into an axial portion of the outer layer. In this case, similarly to the center electrode 400, an inner member can be inserted into an outer member formed in a cup shape, plastic processing such as extruding can be performed, and then plastic processing into a substantially prismatic shape can be performed to obtain the ground electrode 800.

Next, one end of the ground electrode 800 is joined, by means of, for example, electric resistance welding and/or laser welding, to an end surface of the metallic shell 700 which is formed into a predetermined shape by plastic processing or the like. Next, Zn plating or Ni plating is applied to the metallic shell 700 to which the ground electrode 800 has been joined. After the application of the Zn plating or the Ni plating, trivalent chromate treatment may be performed. In addition, the plating applied to the ground electrode may be peeled off.

Next, the electrode tip 900 produced as described above is melted and fixed to the ground electrode 800 by means of electric resistance welding and/or laser welding. In a case where the electrode tip 900 is joined to the ground electrode 800 by means of electric resistance welding, for example, the electrode tip 900 is placed at a predetermined position on the ground electrode 800 and electric resistance welding is performed while the welding electrode is pressed against the end surface of the narrow portion 2. The electrode tip 900 may be joined to the ground electrode 800 by means of laser welding after the electric resistance welding has been performed. In a case where the laser welding is performed, for example, a laser beam is applied, toward a portion to be joined between the electrode tip 900 and the ground electrode 800, from obliquely above the electrode tip 900 or parallel from the outside, in the radial direction, of the electrode tip 900. The laser beam may be applied to a part of the portion, to be joined, of the electrode tip 900 or over the entirety of the circumference of the portion, to be joined, of the electrode tip 900. In a case where the electrode tip 900 is joined to the ground electrode 800 by the laser welding without performing electric resistance welding, the electrode tip 900 is placed at a predetermined position of the ground electrode 800, and the laser welding is performed while the end surface of the narrow portion 2 is held.

The insulator 300 is produced by baking a ceramic material or the like into a predetermined shape. The center electrode 400 is inserted into the axial bore 200 of the insulator 300, and the axial bore 200 is filled with the composition for forming the first seal body 220, the composition for forming the resistor 210, and the composition for forming the second seal body 230, in order, respectively, under preliminary compression. Next, the compositions are compressed and heated while the metal terminal 500 is pressed in through an end portion in the axial bore 200. Thus, the compositions are sintered to form the resistor 210, the first seal body 220, and the second seal body 230. Next, the insulator 300 to which the center electrode 400 and the like have been fixed is mounted to the metallic shell 700 to which the ground electrode 800 has been joined. At the end, a front end portion of the ground electrode 800 is bent toward the center electrode 400 side such that one end of the ground electrode 800 opposes the front end portion of the center electrode 400, so that the spark plug 100 is manufactured.

The spark plug 100 according to the present invention is used as an ignition plug for an internal combustion engine for an automobile, such as a gasoline engine. The spark plug 100 is fixed at a predetermined position by the screw portion 240 being screwed into a screw hole provided in a head (not shown) which defines a combustion chamber of the internal combustion engine. The spark plug 100 according to the present invention can be used for any internal combustion engine, but is suitably used for, in particular, an internal combustion engine in which the electrode tip 900 is exposed to a high temperature environment, or an internal combustion engine in which discharge energy is high and spark wear is likely to occur in the electrode tip 900.

The electrode tip for a spark plug and the spark plug having the electrode tip according to the present invention are not limited to the above-described embodiments, and various changes can be made as long as the purpose of the present invention of the present application can be accomplished.

EXAMPLES

1. Evaluation for Variation in Dimension of Electrode Tip

Figure 8:
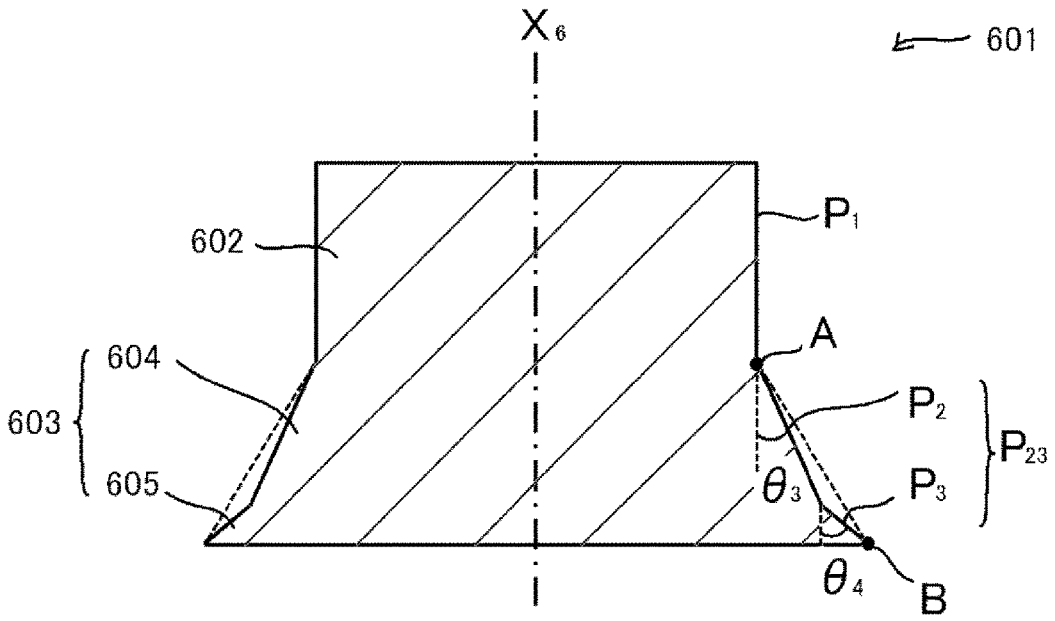
FIG. 8 is an explanatory view illustrating a cross-section, of an electrode tip according to comparative example, which is cut at a plane including an axis of the electrode tip.

The electrode tip was produced as follows. Raw material powder having a predetermined composition was firstly blended, and subjected to arc melting, to form an ingot. Hot and/or cold forging, hot and/or cold rolling, and hot and/or cold swaging were performed on the ingot, and drawing was further performed, to obtain a round bar member having a circular cross-sectional shape. The round bar member was cut so as to have a predetermined length by shear cutting or wire cutting, to obtain an almost column-shaped cut member. The cut member was arranged so as to have a desired shape by cutting and/or forming, to obtain an electrode tip. In Table 1, "S" represents a case where shear cutting was performed on the round bar member, and "W" represents a case where wire cutting was performed on the round bar member. Further, "a" represents a case where the outer shape of the electrode tip is the same as that of the electrode tip shown in FIG. 4 except that no projection is provided, "b" represents a case where the outer shape of the electrode tip is the same as that of the electrode tip shown in FIG. 1, "c" represents a case where the outer shape of the electrode tip is the same as that of the electrode tip shown in FIG. 5, and "d" represents a case where the outer shape of the electrode tip is the same as that of the electrode tip shown in FIG. 8. A wide portion 603 of the electrode tip shown in FIG. 8 is formed by a first tapered portion 604 and a second tapered portion 605, and a taper angle $\theta_3$ of the first tapered portion 604 is less than a taper angle $\theta_4$ of the second tapered portion 605. Therefore, the entirety of the contour $P_{23}$ representing the outer surface of the wide portion 603 is inward of the straight line AB in the radial direction.

The obtained electrode tip was welded to a ground electrode formed from a Ni alloy by electric resistance welding, and was then joined thereto by laser welding. In the electric resistance welding, a load was applied, to the electrode tip having been welded to the ground electrode by electric resistance welding, from the outside, in the radial direction, of the electrode tip, and a current value of electricity to be applied to the electrode tip and the ground electrode, and a value of load to be applied to the electrode tip in the axial direction, were determined such that a breaking strength measured when the electrode tip was broken from the ground electrode was 100 N. In the laser welding, a laser application position and application energy were adjusted as appropriate such that a distance to the end surface of the electrode tip from the front end portion, in the axial direction, of a melt portion formed by the electrode tip and the ground electrode being melted was 0.25 mm.

The composition in the electrode tip was measured by WDS analysis of FE-EPMA (JXA-8500F manufactured by JEOL Ltd). The electrode tip was firstly cut at a plane including the axis thereof, and a plurality of measurement points were selected on the cut surface as described above, and the mass composition was measured. Subsequently, the arithmetic mean of a plurality of measured values was calculated, and the mean value was regarded as the composition of the electrode tip.

The hardness of the inner portion of the narrow portion of the electrode tip and the hardness of the end surface of the narrow portion thereof were measured by using a Vickers hardness tester at a load of 1N and at a retention time of 10 seconds in compliance with the standard of JIS Z 2244 as described above. For the hardness of the end surface of the narrow portion, any plural locations near the surface center of the end surface of the narrow portion of the electrode tip as viewed in the direction of the axis X were selected, and the hardness was measured. For the hardness of the inner portion of the narrow portion, any plural locations near the center of the narrow portion on the cut surface prepared when the composition in the electrode tip was measured, were selected, and the hardness was measured. The arithmetic mean of the measured hardness values was calculated for each of the inner portion and the end surface, and the respective mean values having been obtained were regarded as the hardness Hb of the inner portion of the narrow portion, and the hardness Hs of the end surface of the narrow portion as indicated in Table 1.

Evaluation for variation in dimension after welding of the electrode tip to the ground electrode was made as follows. A distance Ha, from the surface of the ground electrode to the front end surface of the electrode tip, obtained after welding of the electrode tip to the ground electrode by the electric resistance welding and the laser welding, was measured by a projector. A tip height of the electrode tip having not been welded yet was represented as H, and a displacement Y(=H−Ha) in height between the tip having not been welded and the tip having been welded was calculated. The displacement Y was obtained for 50 samples in a similar manner, and a standard deviation σ of the displacements of the 50 samples, was calculated and variation in dimension was evaluated according to the following criterions. The result is indicated in Table 1.

A: When the standard deviation σ was less than 0.004 mm.

B: When the standard deviation σ was greater than or equal to 0.004 mm, and less than 0.007 mm.

D: When the standard deviation σ was greater than or equal to 0.007 mm.

2. Evaluation for Durability

Similarly to "1. Evaluation for variation in dimension of electrode tip", the electrode tip was produced and joined to the ground electrode, and the electrode tip and the ground electrode joined to each other was used to produce a spark plug test body having the same shape as the spark plug shown in FIG. 7.

The produced spark plug test body was mounted to a four-cylinder engine (spark discharge voltage of 15 kv), for testing, having 2 L, and durability test in which operation was performed for 200 hours at full throttle (WOT) with a state of an engine speed of 5000 rpm being maintained, was made. At this time, the temperature of the front end portion of the ground electrode was 950° C.

The volume of the electrode tip was measured before and after the durability test with a CT scan (TOSCANER-32250μhd manufactured by Toshiba Corporation), and a wearing rate $\Delta V$ ($=V_1-V_2$) representing a difference between a volume $V_1$ of the electrode tip before the durability test and a volume $V_2$ of the electrode tip after the durability test, was obtained. Further, a wearing rate of an electrode tip containing 65% by mass of Pt and 35% by mass of Rh, and having the same shape as the above electrode tip, was set as a reference wearing rate $\Delta V_0$, and a wearing ratio ($=(\Delta V-\Delta V_0)/\Delta V_0$) of the difference ($\Delta V-\Delta V_0$) between the wearing rate and the reference wearing rate, relative to the reference wearing rate $\Delta V_0$, was calculated. Thus, evaluation for durability was made according to the following criterions. The result is indicated in Table 1.

B: When the wearing ratio is less than 0.1.

D: When the wearing ratio is greater than or equal to 0.1.

3. Evaluation for Outer Appearance of Electrode Tip Having been Welded to Ground Electrode After the electric resistance welding, the laser welding, or the durability test, the electrode tip or the melt portion was observed by using a magnifier at 30× magnification, to check for presence or absence of cracks generated in the electrode tip and the melt portion. In a case where a crack was observed, the crack was observed at a higher magnification, and a distance, in a straight line, of the crack was measured. For example, in a case where the crack was bent so as to be zigzag-shaped, the shortest distance between both ends of the crack instead of the entire length of the crack, was measured. In Table 1, "C" represents a case where a crack was observed and the distance thereof in a straight line was longer than or equal to 0.05 mm, and "B" represents a case where no crack was observed or a case where a crack was observed, but the distance thereof in a straight line was less than 0.05 mm.

TABLE 1

| | | Composition in electrode tip (% by mass) | | | | | Structure of electrode tip | | | | |
|---|---|---|---|---|---|---|---|---|---|---|---|
| | | | | Group A | | Group B | Hardness of inner portion of narrow portion | Hardness of end surface of narrow portion | Area S' of end surface of narrow portion | Area S of end surface of wide portion | |
| | No | Pt | Rh | Ni | Ir | Zr | Hb (Hv) | Hs (Hv) | ($mm^2$) | ($mm^2$) | S/S' |
| Comp. Ex. | 1 | 82 | 18 | 0 | 0 | 0 | 210 | 260 | 0.79 | 0.95 | 1.20 |
| Comp. Ex. | 2 | 82 | 18 | 0 | 0 | 0 | 220 | 200 | 0.79 | 0.95 | 1.20 |
| Comp. Ex. | 3 | 82 | 18 | 0 | 0 | 0 | 250 | 310 | 0.38 | 0.40 | 1.05 |
| Example | 4 | 82 | 18 | 0 | 0 | 0 | 220 | 220 | 0.38 | 0.46 | 1.21 |
| Comp. Ex. | 5 | 82 | 18 | 0 | 0 | 0 | 220 | 190 | 0.38 | 0.46 | 1.21 |
| Example | 6 | 82 | 18 | 0 | 0 | 0 | 220 | 220 | 0.50 | 0.60 | 1.20 |
| Example | 7 | 82 | 18 | 0 | 0 | 0 | 220 | 220 | 0.79 | 0.95 | 1.20 |
| Comp. Ex. | 8 | 82 | 18 | 0 | 0 | 0 | 220 | 170 | 0.79 | 0.95 | 1.20 |
| Comp. Ex. | 9 | 82 | 18 | 0 | 0 | 0 | 220 | 210 | 0.79 | 0.95 | 1.20 |
| Comp. Ex. | 10 | 82 | 18 | 0 | 0 | 0 | 220 | 260 | 1.13 | 1.20 | 1.06 |
| Example | 11 | 82 | 18 | 0 | 0 | 0 | 220 | 270 | 1.13 | 1.36 | 1.20 |
| Example | 12 | 82 | 18 | 0 | 0 | 0 | 220 | 220 | 1.13 | 1.36 | 1.20 |
| Example | 13 | 82 | 18 | 0 | 0 | 0 | 260 | 310 | 1.13 | 1.36 | 1.20 |
| Example | 14 | 82 | 18 | 0 | 0 | 0 | 250 | 250 | 0.79 | 0.95 | 1.20 |
| Example | 15 | 82 | 18 | 0 | 0 | 0 | 230 | 290 | 0.79 | 0.95 | 1.20 |
| Example | 16 | 82 | 18 | 0 | 0 | 0 | 250 | 310 | 0.79 | 0.95 | 1.20 |
| Example | 17 | 82 | 18 | 0 | 0 | 0 | 310 | 310 | 0.79 | 0.95 | 1.20 |
| Example | 18 | 82 | 18 | 0 | 0 | 0 | 320 | 400 | 0.79 | 0.95 | 1.20 |
| Comp. Ex. | 19 | 82 | 18 | 0 | 0 | 0 | 220 | 280 | 0.79 | 0.95 | 1.20 |
| Comp. Ex. | 20 | 82 | 18 | 0 | 0 | 0 | 230 | 290 | 0.79 | 0.95 | 1.20 |
| Example | 21 | 82 | 18 | 0 | 0 | 0 | 220 | 280 | 0.79 | 0.95 | 1.20 |
| Example | 22 | 82 | 18 | 0 | 0 | 0 | 240 | 300 | 0.79 | 0.95 | 1.20 |
| Example | 23 | 82 | 18 | 0 | 0 | 0 | 220 | 290 | 0.79 | 0.95 | 1.20 |
| Comp. Ex. | 24 | 82 | 18 | 0 | 0 | 0 | 230 | 290 | 0.79 | 0.95 | 1.20 |
| Comp. Ex. | 25 | 82 | 18 | 0 | 0 | 0 | 240 | 310 | 0.79 | 0.95 | 1.20 |
| Example | 26 | 82 | 18 | 0 | 0 | 0 | 220 | 290 | 0.79 | 0.95 | 1.20 |
| Example | 27 | 82 | 18 | 0 | 0 | 0 | 220 | 300 | 0.79 | 0.95 | 1.20 |
| Comp. Ex. | 28 | 82 | 18 | 0 | 0 | 0 | 220 | 280 | 0.79 | 0.79 | 1.00 |
| Comp. Ex. | 29 | 82 | 18 | 0 | 0 | 0 | 240 | 300 | 0.79 | 0.87 | 1.10 |
| Example | 30 | 82 | 18 | 0 | 0 | 0 | 220 | 300 | 0.79 | 1.13 | 1.43 |
| Example | 31 | 82 | 18 | 0 | 0 | 0 | 220 | 220 | 0.79 | 1.54 | 1.95 |
| Example | 32 | 82 | 18 | 0 | 0 | 0 | 220 | 310 | 0.79 | 1.54 | 1.95 |
| Example | 33 | 82 | 18 | 0 | 0 | 0 | 220 | 220 | 0.79 | 1.77 | 2.24 |
| Example | 34 | 82 | 18 | 0 | 0 | 0 | 260 | 320 | 0.79 | 2.01 | 2.54 |
| Comp. Ex. | 35 | 82 | 18 | 0 | 0 | 0 | 220 | 260 | 0.79 | 0.95 | 1.20 |
| Comp. Ex. | 36 | 82 | 18 | 0 | 0 | 0 | 240 | 280 | 0.79 | 0.95 | 1.20 |
| Comp. Ex. | 37 | 82 | 18 | 0 | 0 | 0 | 220 | 270 | 0.79 | 0.87 | 1.10 |
| Comp. Ex. | 38 | 82 | 18 | 0 | 0 | 0 | 220 | 190 | 0.38 | 0.46 | 1.21 |
| Example | 39 | 82 | 18 | 0 | 0 | 0 | 220 | 220 | 0.38 | 0.46 | 1.21 |
| Example | 40 | 82 | 18 | 0 | 0 | 0 | 220 | 220 | 0.5 | 0.6 | 1.20 |
| Example | 41 | 82 | 18 | 0 | 0 | 0 | 220 | 220 | 0.79 | 0.95 | 1.20 |
| Example | 42 | 82 | 18 | 0 | 0 | 0 | 220 | 310 | 0.79 | 0.95 | 1.20 |
| Example | 43 | 82 | 18 | 0 | 0 | 0 | 220 | 300 | 0.79 | 1.54 | 1.95 |
| Example | 44 | 82 | 18 | 0 | 0 | 0 | 220 | 220 | 0.79 | 0.95 | 1.20 |
| Comp. Ex. | 45 | 82 | 18 | 0 | 0 | 0 | 220 | 200 | 0.79 | 0.95 | 1.20 |
| Comp. Ex. | 46 | 82 | 18 | 0 | 0 | 0 | 230 | 290 | 0.79 | 0.95 | 1.20 |
| Example | 47 | 82 | 18 | 0 | 0 | 0 | 220 | 290 | 0.79 | 0.95 | 1.20 |
| Example | 48 | 82 | 18 | 0 | 0 | 0 | 220 | 290 | 0.79 | 0.95 | 1.20 |
| Comp. Ex. | 49 | 82 | 18 | 0 | 0 | 0 | 210 | 280 | 0.79 | 0.95 | 1.20 |
| Example | 50 | 82 | 18 | 0 | 0 | 0 | 220 | 220 | 0.79 | 0.95 | 1.20 |
| Example | 51 | 82 | 18 | 0 | 0 | 0 | 340 | 310 | 0.79 | 0.95 | 1.20 |

TABLE 1-continued

| | | | | | | | | | | | |
|---|---|---|---|---|---|---|---|---|---|---|---|
| Example | 52 | 82 | 18 | 0 | 0 | 0 | 350 | 350 | 0.79 | 0.95 | 1.20 |
| Example | 53 | 82 | 18 | 0 | 0 | 0 | 220 | 220 | 0.79 | 0.95 | 1.20 |
| Example | 54 | 82 | 18 | 0 | 0 | 0 | 220 | 220 | 0.79 | 0.95 | 1.20 |
| Comp. Ex. | 55 | 82 | 18 | 0 | 0 | 0 | 220 | 220 | 0.79 | 0.95 | 1.20 |
| Comp. Ex. | 56 | 100 | 0 | 0 | 0 | 0 | 220 | 280 | 0.79 | 0.95 | 1.20 |
| Comp. Ex. | 57 | 95 | 5 | 0 | 0 | 0 | 230 | 290 | 0.79 | 0.95 | 1.20 |
| Example | 58 | 93 | 7 | 0 | 0 | 0 | 220 | 280 | 0.79 | 0.95 | 1.20 |
| Example | 59 | 75 | 25 | 0 | 0 | 0 | 240 | 300 | 0.79 | 0.95 | 1.20 |
| Example | 60 | 65 | 35 | 0 | 0 | 0 | 220 | 290 | 0.79 | 0.95 | 1.20 |
| Example | 61 | 60 | 40 | 0 | 0 | 0 | 220 | 290 | 0.79 | 0.95 | 1.20 |
| Example | 62 | 62 | 35 | 0 | 3 | 0 | 220 | 290 | 0.79 | 0.95 | 1.20 |
| Example | 63 | 60 | 35 | 0 | 5 | 0 | 220 | 290 | 0.79 | 0.95 | 1.20 |
| Comp. Ex. | 64 | 59 | 35 | 0 | 6 | 0 | 220 | 300 | 0.79 | 0.95 | 1.20 |
| Example | 65 | 62 | 35 | 3 | 0 | 0 | 220 | 290 | 0.79 | 0.95 | 1.20 |
| Example | 66 | 60 | 35 | 5 | 0 | 0 | 220 | 310 | 0.79 | 0.95 | 1.20 |
| Comp. Ex. | 67 | 59 | 35 | 6 | 0 | 0 | 220 | 320 | 0.79 | 0.95 | 1.20 |
| Example | 68 | 60 | 35 | 2 | 3 | 0 | 220 | 300 | 0.79 | 0.95 | 1.20 |
| Comp. Ex. | 69 | 59 | 35 | 3 | 3 | 0 | 250 | 340 | 0.79 | 0.95 | 1.20 |
| Example | 70 | 64.95 | 35 | 0 | 0 | 0.05 | 220 | 280 | 0.79 | 0.95 | 1.20 |
| Example | 71 | 64.93 | 35 | 0 | 0 | 0.07 | 240 | 300 | 0.79 | 0.95 | 1.20 |
| Example | 72 | 64.9 | 35 | 0 | 0 | 0.1 | 220 | 300 | 0.79 | 0.95 | 1.20 |
| Example | 73 | 64.85 | 35 | 0 | 0 | 0.15 | 220 | 300 | 0.79 | 0.95 | 1.20 |

| | | Structure of electrode tip | | | | | | Evaluation results | | |
|---|---|---|---|---|---|---|---|---|---|---|
| | No | Outer shape | Tip height H (mm) | Narrow portion height L (mm) | Wide portion height h (mm) | h/H × 100 | Cutting method | Durability | Variation in dimension | Outer appearance after welding |
| Comp. Ex. | 1 | a | 0.85 | 0.55 | 0.30 | 35 | S | — | D | B |
| Comp. Ex. | 2 | a | 0.85 | 0.55 | 0.30 | 35 | W | — | D | B |
| Comp. Ex. | 3 | a | 0.85 | 0.55 | 0.30 | 35 | S | — | D | B |
| Example | 4 | a | 0.85 | 0.55 | 0.30 | 35 | W | — | B | B |
| Comp. Ex. | 5 | a | 0.85 | 0.55 | 0.30 | 35 | W | — | D | B |
| Example | 6 | a | 0.85 | 0.55 | 0.30 | 35 | W | — | B | B |
| Example | 7 | a | 0.85 | 0.55 | 0.30 | 35 | W | B | B | B |
| Comp. Ex. | 8 | a | 0.85 | 0.55 | 0.30 | 35 | W | — | D | B |
| Comp. Ex. | 9 | a | 0.85 | 0.55 | 0.30 | 35 | W | — | D | B |
| Comp. Ex. | 10 | a | 0.85 | 0.55 | 0.30 | 35 | S | — | D | B |
| Example | 11 | a | 0.85 | 0.55 | 0.30 | 35 | S | — | B | B |
| Example | 12 | a | 0.85 | 0.55 | 0.30 | 35 | W | — | B | B |
| Example | 13 | a | 0.85 | 0.55 | 0.30 | 35 | S | — | A | B |
| Example | 14 | a | 0.85 | 0.55 | 0.30 | 35 | W | — | B | B |
| Example | 15 | a | 0.85 | 0.55 | 0.30 | 35 | S | — | B | B |
| Example | 16 | a | 0.85 | 0.55 | 0.30 | 35 | S | — | A | B |
| Example | 17 | a | 0.85 | 0.55 | 0.30 | 35 | S | — | A | C |
| Example | 18 | a | 0.85 | 0.55 | 0.30 | 35 | S | — | A | C |
| Comp. Ex. | 19 | a | 0.85 | 0.75 | 0.10 | 12 | S | — | D | C |
| Comp. Ex. | 20 | a | 0.85 | 0.60 | 0.25 | 29 | S | — | D | C |
| Example | 21 | a | 0.85 | 0.55 | 0.30 | 35 | S | — | B | B |
| Example | 22 | a | 0.85 | 0.45 | 0.40 | 47 | S | — | B | B |
| Example | 23 | a | 0.85 | 0.30 | 0.55 | 65 | S | — | B | B |
| Comp. Ex. | 24 | a | 0.7 | 0.55 | 0.15 | 21 | S | — | D | C |
| Comp. Ex. | 25 | a | 0.7 | 0.50 | 0.50 | 29 | S | — | D | C |
| Example | 26 | a | 0.7 | 0.45 | 0.25 | 36 | S | — | B | B |
| Example | 27 | a | 0.7 | 0.30 | 0.40 | 57 | S | — | B | B |
| Comp. Ex. | 28 | a | 0.85 | 0.85 | 0.00 | 0 | S | — | D | B |
| Comp. Ex. | 29 | a | 0.85 | 0.55 | 0.30 | 35 | S | — | D | B |
| Example | 30 | a | 0.85 | 0.55 | 0.30 | 35 | S | — | B | B |
| Example | 31 | a | 0.85 | 0.55 | 0.30 | 35 | W | — | B | B |
| Example | 32 | a | 0.85 | 0.55 | 0.30 | 35 | S | — | A | B |
| Example | 33 | a | 0.85 | 0.55 | 0.30 | 35 | W | — | B | B |
| Example | 34 | a | 0.85 | 0.55 | 0.30 | 35 | S | — | B | B |
| Comp. Ex. | 35 | b | 0.85 | 0.80 | 0.05 | 6 | S | — | D | C |
| Comp. Ex. | 36 | b | 0.85 | 0.65 | 0.20 | 24 | S | — | D | C |
| Comp. Ex. | 37 | b | 0.85 | 0.55 | 0.30 | 35 | S | — | D | B |
| Comp. Ex. | 38 | b | 0.85 | 0.55 | 0.30 | 35 | W | — | D | B |
| Example | 39 | b | 0.85 | 0.55 | 0.30 | 35 | W | — | B | B |
| Example | 40 | b | 0.85 | 0.55 | 0.30 | 35 | W | — | B | B |
| Example | 41 | b | 0.85 | 0.55 | 0.30 | 35 | W | — | B | B |
| Example | 42 | b | 0.85 | 0.55 | 0.30 | 35 | S | — | A | B |
| Example | 43 | b | 0.85 | 0.55 | 0.30 | 35 | S | — | B | B |
| Example | 44 | b | 0.85 | 0.35 | 0.50 | 59 | W | — | B | B |
| Comp. Ex. | 45 | b | 0.85 | 0.55 | 0.30 | 35 | W | — | D | B |
| Comp. Ex. | 46 | c | 1.05 | 0.75 | 0.30 | 29 | S | — | D | C |
| Example | 47 | c | 1.05 | 0.68 | 0.37 | 35 | S | — | B | B |
| Example | 48 | c | 1.05 | 0.55 | 0.50 | 48 | S | — | B | B |

TABLE 1-continued

| | | | | | | | | | | |
|---|---|---|---|---|---|---|---|---|---|---|
| Comp. Ex. | 49 | c | 0.85 | 0.55 | 0.30 | 35 | S | — | D | B |
| Example | 50 | c | 0.85 | 0.55 | 0.30 | 35 | W | — | B | B |
| Example | 51 | c | 0.85 | 0.55 | 0.30 | 35 | W | — | A | C |
| Example | 52 | c | 0.85 | 0.55 | 0.30 | 35 | W | — | A | C |
| Example | 53 | c | 0.85 | 0.40 | 0.45 | 53 | W | — | B | B |
| Example | 54 | c | 0.85 | 0.30 | 0.55 | 65 | W | — | B | B |
| Comp. Ex. | 55 | d | 0.85 | 0.55 | 0.30 | 35 | W | — | D | B |
| Comp. Ex. | 56 | a | 0.85 | 0.55 | 0.30 | 35 | S | B | D | B |
| Comp. Ex. | 57 | a | 0.85 | 0.55 | 0.30 | 35 | S | B | D | B |
| Example | 58 | a | 0.85 | 0.55 | 0.30 | 35 | S | B | B | B |
| Example | 59 | a | 0.85 | 0.55 | 0.30 | 35 | S | B | B | B |
| Example | 60 | a | 0.85 | 0.55 | 0.30 | 35 | S | B | B | B |
| Example | 61 | a | 0.85 | 0.55 | 0.30 | 35 | S | B | B | C |
| Example | 62 | a | 0.85 | 0.55 | 0.30 | 35 | S | B | B | B |
| Example | 63 | a | 0.85 | 0.55 | 0.30 | 35 | S | B | B | B |
| Comp. Ex. | 64 | a | 0.85 | 0.55 | 0.30 | 35 | S | D | B | B |
| Example | 65 | a | 0.85 | 0.55 | 0.30 | 35 | S | B | B | B |
| Example | 66 | a | 0.85 | 0.55 | 0.30 | 35 | S | B | A | B |
| Comp. Ex. | 67 | a | 0.85 | 0.55 | 0.30 | 35 | S | D | B | B |
| Example | 68 | a | 0.85 | 0.55 | 0.30 | 35 | S | B | B | B |
| Comp. Ex. | 69 | a | 0.85 | 0.55 | 0.30 | 35 | S | D | B | B |
| Example | 70 | a | 0.85 | 0.55 | 0.30 | 35 | S | B | B | B |
| Example | 71 | a | 0.85 | 0.55 | 0.30 | 35 | S | B | B | B |
| Example | 72 | a | 0.85 | 0.55 | 0.30 | 35 | S | B | B | B |
| Example | 73 | a | 0.85 | 0.55 | 0.30 | 35 | S | B | B | C |

As indicated in Table 1, the spark plugs having the electrode tips within the scope of the present invention are excellent in durability, and variation in dimension among the electrode tips having been welded to electrodes is small.

4. Evaluation for Variation in Dimension Due to Area S' of End Surface of Narrow Portion of Electrode Tip being Varied The ratio (S/S') of the area S of the end surface of the wide portion to the area S' of the end surface of the narrow portion was fixed as 1.2, and the area S' of the end surface of the narrow portion and the area S of the end surface of the wide portion were variously changed. In this case, variation in dimension of the electrode tip was obtained in the same manner as in "1. Evaluation for variation in dimension of electrode tip". The composition and structure of each electrode tip used in the test were the same as those used in test number 42 except for the area S' of the end surface of the narrow portion and the area S of the end surface of the wide portion. Further, variation in dimension of a column-shaped electrode tip in which the area of the end surface was the same as the area S' of the end surface of the narrow portion, was obtained in the same manner as in "1. Evaluation for variation in dimension of electrode tip", and the dimension variation YS of the column-shaped electrode tip was used as a reference, and the dimension variation ratio ((Ys/YS)× 100%) was obtained. The result is shown in FIG. 9.

Figure 9:
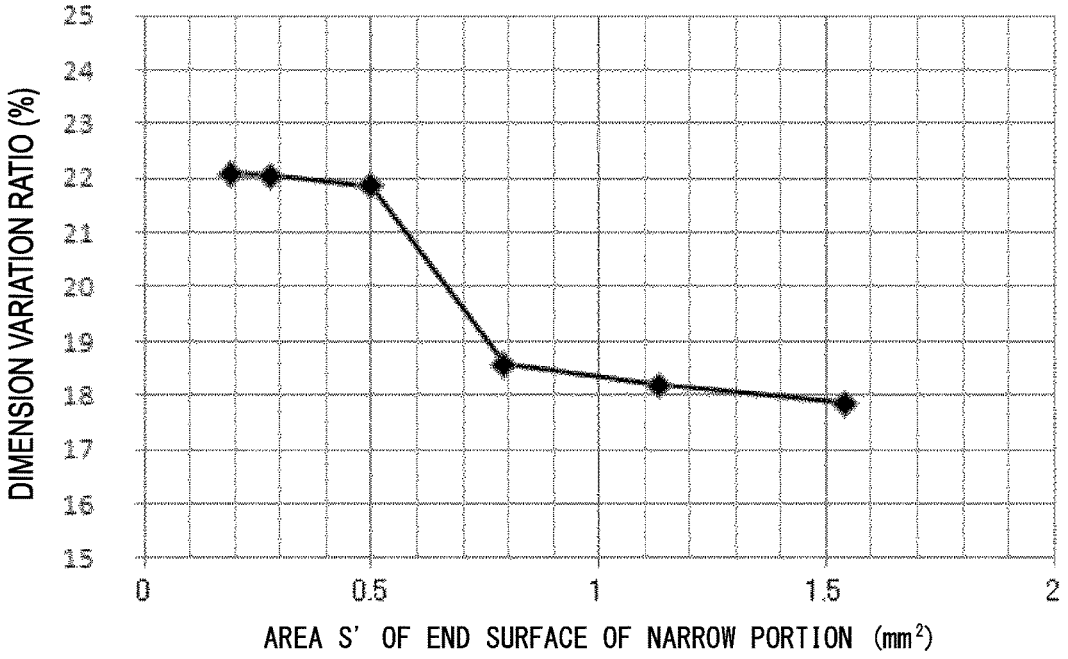
FIG. 9 is a graph showing a relationship between an area S' of an end surface of a narrow portion and a dimension variation ratio (%).

As shown in FIG. 9, when the area S' of the end surface of the narrow portion of the electrode tip is greater than 0.5 $mm^2$, the dimension variation ratio is less than the dimension variation ratio obtained when the area S' is less than or equal to 0.5 $mm^2$. Therefore, it is found that, when the area S' of the end surface of the narrow portion of the electrode tip is greater than 0.5 $mm^2$, an effect of reducing deformation of the electrode tip when the electrode tip is welded to an electrode by electric resistance welding, is enhanced.

DESCRIPTION OF REFERENCE NUMERALS

1, 101, 201, 301, 401, 501, 601: electrode tip
2, 102, 202, 302, 402, 502, 602: narrow portion
3, 103, 203, 303, 403, 503, 603: wide portion
4, 104, 204, 304, 404, 504, 604: tapered portion
5, 105, 205, 305, 405, 505, 605: column-shaped portion
306: projection
100: spark plug
200: axial bore
300: insulator
400: center electrode
500: metal terminal
600: connection portion
700: metallic shell
800: ground electrode
900: electrode tip
110: rear trunk portion
120: large diameter portion
130: front trunk portion
140: leg portion
150: ledge portion
160: flange portion
170: stepped portion
180: tapered portion
190: sheet packing
210: resistor
220: first seal body
230: second seal body
240: screw portion
250: gas seal portion
260: tool engagement portion
270: crimping portion
280, 290: packing
310: talc
320: projection
340: rear end portion
350: rod-shaped portion Having described the invention, the following is claimed:

1. An electrode tip for a spark plug, the electrode tip containing Pt as a main component and 7% by mass or more of Rh, a total content of Pt and Rh being greater than or equal to 95% by mass, the electrode tip comprising:

a narrow portion having a column-like shape and having the same cross-sectional shape in a direction of an axis; and a wide portion adjacent to the narrow portion, the wide portion having a cross-sectional area, in a direction orthogonal to the axis, which is greater than the narrow portion, wherein, on any cross-section cut at a plane including the axis, at least a part of a contour, representing an outer surface of the wide portion, from a boundary point between the narrow portion and the wide portion on an outer surface of the narrow portion and the wide portion, to an end point, on the boundary point side, among two points representing edge sides of an end surface of the wide portion, is positioned on a straight line connecting between the boundary point and the end point and/or outward of the straight line in a radial direction relative to the axis, wherein, when H represents a tip height representing a distance from an end surface of the narrow portion to the end surface of the wide portion, and h represents a wide portion height representing a distance from the boundary point to the end surface of the wide portion, a ratio (h/H×100) of the wide portion height h to the tip height H is greater than or equal to 35%, wherein a ratio (S/S') of an area S of the end surface of the wide portion to an area S' of the end surface of the narrow portion is in a range from 1.2 to 2.2, wherein the area S' is greater than 0.5 $mm^2$, and wherein a hardness of the narrow portion is greater than or equal to 220 Hv.

2. The electrode tip for a spark plug according to claim 1, wherein a hardness of the end surface of the narrow portion is greater than or equal to 310 Hv.

3. The electrode tip for a spark plug according to claim 1, wherein, on any cross-section cut at a plane including the axis, an entirety of the contour, representing the outer surface of the wide portion, from the boundary point between the narrow portion and the wide portion on the outer surface of the narrow portion and the wide portion, to the end point, on the boundary point side, among the two points representing the edge sides of the end surface of the wide portion, is positioned on the straight line connecting between the boundary point and the end point and/or outward of the straight line in the radial direction relative to the axis.

4. A spark plug comprising:

a center electrode held at one end side in an axial bore that extends in an axial direction of an insulator, a ground electrode having one end portion joined to a metallic shell provided on an outer circumference of the insulator, the ground electrode having the other end portion disposed such that a gap is formed between the other end portion and the center electrode, and an electrode tip containing Pt as a main component and 7% by mass or more of Rh, a total content of Pt and Rh being greater than or equal to 95% by mass, the electrode tip comprising:

a narrow portion having a column-like shape and having the same cross-sectional shape in a direction of an axis; and a wide portion adjacent to the narrow portion, the wide portion having a cross-sectional area, in a direction orthogonal to the axis, which is greater than the narrow portion, wherein, on any cross-section cut at a plane including the axis, at least a part of a contour, representing an outer surface of the wide portion, from a boundary point between the narrow portion and the wide portion on an outer surface of the narrow portion and the wide portion, to an end point, on the boundary point side, among two points representing edge sides of an end surface of the wide portion, is positioned on a straight line connecting between the boundary point and the end point and/or outward of the straight line in a radial direction relative to the axis, wherein, when H represents a tip height representing a distance from an end surface of the narrow portion to the end surface of the wide portion, and h represents a wide portion height representing a distance from the boundary point to the end surface of the wide portion, a ratio (h/H×100) of the wide portion height h to the tip height H is greater than or equal to 35%, wherein a ratio (S/S') of an area S of the end surface of the wide portion to an area S' of the end surface of the narrow portion is in a range from 1.2 to 2.2, wherein the area S' is greater than 0.5 $mm^2$, wherein a hardness of the narrow portion is greater than or equal to 220 Hv, and wherein said electrode tip is joined to at least one of the center electrode and the ground electrode by welding.

5. A spark plug according to claim 4, wherein the electrode tip is joined to at least one of the center electrode and the ground electrode by laser welding.

6. A spark plug according to claim 4, wherein the electrode tip is joined to at least one of the center electrode and the ground electrode by electric resistance welding.

* * * * *